US010119685B2

(12) United States Patent
Boulanger et al.

(10) Patent No.: US 10,119,685 B2
(45) Date of Patent: Nov. 6, 2018

(54) LIGHTING ARRANGEMENT

(71) Applicant: CP IP Holdings Limited, Central Hong Kong (CN)

(72) Inventors: Dave Boulanger, Hong Kong (CN); Maciej Nowakowski, West Vancouver (CA)

( * ) Notice: Subject to any disclaimer, the term of this patent is extended or adjusted under 35 U.S.C. 154(b) by 221 days.

(21) Appl. No.: 15/248,720

(22) Filed: Aug. 26, 2016

(65) Prior Publication Data

US 2016/0363297 A1 Dec. 15, 2016

Related U.S. Application Data

(63) Continuation-in-part of application No. 14/956,416, filed on Dec. 2, 2015, and a continuation-in-part of
(Continued)

(51) Int. Cl.
*F21V 17/00* (2006.01)
*F21V 21/04* (2006.01)
(Continued)

(52) U.S. Cl.
CPC ..... *F21V 21/04* (2013.01); *F21V 17/005* (2013.01); *F21V 17/14* (2013.01); *F21S 8/024* (2013.01);
(Continued)

(58) Field of Classification Search
CPC ..... F21V 21/04; F21V 17/005; F21V 17/14; F21Y 2103/33; F21Y 2115/10; F21S 8/024; F21S 8/026
See application file for complete search history.

(56) References Cited

U.S. PATENT DOCUMENTS 5,642,934 A * 7/1997 Haddad ..... F21V 15/01 362/147
6,082,871 A 7/2000 Yeh
(Continued)

FOREIGN PATENT DOCUMENTS

CA 2586494 A1 10/2007
CA 2754514 A1 4/2012
(Continued)

OTHER PUBLICATIONS

European Search Report for application No. 16150077.2, May 23, 2016, 10 pgs.
(Continued)

*Primary Examiner* — Anh Mai
*Assistant Examiner* — Fatima Farokhrooz

(57) ABSTRACT

A lighting arrangement can include a mounting ring, a luminaire, locking arms, and posts. The mounting ring can extend along a central longitudinal axis. The luminaire can have a housing assembly and a light emitter. The locking arms can each include a circumferential portion extending about the central longitudinal axis. The circumferential portions can each extend from a first end to a second end distal relative to the first end and each can have an upper face and a lower face. The mounting ring and the luminaire can be interconnected by moving the posts past the second ends along the central longitudinal axis, rotating the mounting ring and the luminaire relative to one another about the central longitudinal axis to slide the posts along one of the upper and lower faces.

19 Claims, 16 Drawing Sheets

Related U.S. Application Data application No. 14/986,760, filed on Jan. 4, 2016, now Pat. No. 9,921,364.

(60) Provisional application No. 62/210,464, filed on Aug. 27, 2015, provisional application No. 62/086,820, filed on Dec. 3, 2014, provisional application No. 62/099,492, filed on Jan. 3, 2015.

(51) Int. Cl.

| | |
|---|---|
| ***F21V 17/14*** | (2006.01) |
| *F21S 8/02* | (2006.01) |
| *F21Y 115/10* | (2016.01) |
| *F21Y 103/33* | (2016.01) |

(52) U.S. Cl.

CPC ..... *F21S 8/026* (2013.01); *F21Y 2103/33* (2016.08); *F21Y 2115/10* (2016.08)

(56) References Cited

U.S. PATENT DOCUMENTS

| | | | | |
|---|---|---|---|---|
| 6,350,045 | B1 * | 2/2002 | Pearce | F21V 17/14 362/363 |
| 6,474,846 | B1 | 11/2002 | Kelmelis et al. | |
| 7,273,983 | B1 | 9/2007 | Rintz | |
| 7,631,993 | B2 * | 12/2009 | Russello | F21V 17/14 362/362 |
| 8,333,491 | B1 | 12/2012 | Chou et al. | |
| 8,376,777 | B2 | 2/2013 | Smith | |
| 2003/0151925 | A1 * | 8/2003 | Crunk | B60Q 1/2615 362/545 |
| 2008/0278958 | A1 | 11/2008 | Jiang | |
| 2009/0203260 | A1 | 8/2009 | Vogt et al. | |
| 2009/0213595 | A1 | 8/2009 | Alexander et al. | |
| 2010/0091484 | A1 | 4/2010 | Mayfield et al. | |
| 2011/0032723 | A1 * | 2/2011 | Gerhard | F21S 48/1104 362/538 |
| 2012/0187852 | A1 | 7/2012 | Mandy et al. | |
| 2012/0261992 | A1 | 10/2012 | Parker et al. | |
| 2012/0268894 | A1 | 10/2012 | Alexander et al. | |
| 2013/0033872 | A1 | 2/2013 | Randolph et al. | |
| 2013/0141890 | A1 * | 6/2013 | Carlin | F21V 23/026 362/20 |
| 2013/0153731 | A1 | 6/2013 | Engstrom et al. | |
| 2013/0342342 | A1 | 12/2013 | Sabre et al. | |
| 2014/0071687 | A1 | 3/2014 | Tickner et al. | |
| 2014/0092606 | A1 | 4/2014 | Potucek et al. | |
| 2014/0092608 | A1 | 4/2014 | Moser et al. | |
| 2014/0268768 | A1 | 9/2014 | Holland et al. | |
| 2016/0230973 | A1 | 8/2016 | Shaw | |

FOREIGN PATENT DOCUMENTS

| | | | |
|---|---|---|---|
| CA | 2766601 | A1 | 6/2013 |
| DE | 4030077 | A1 | 3/1992 |
| EP | 3029369 | A1 | 6/2016 |
| GB | 2500797 | A | 10/2013 |
| JP | 2010287459 | A | 12/2010 |
| KR | 100985710 | B1 | 10/2010 |
| WO | 2013058060 | A1 | 4/2013 |
| WO | 2013175233 | A2 | 11/2013 |

OTHER PUBLICATIONS

Extended European Search Report for Application No. 16275119.2 dated Feb. 13, 2017.

Extended European Search Report for Application No. 16275120.0 dated Feb. 14, 2017.

Communication Issued by European Patent Office in Application 15197462.3-1757; dated Apr. 6, 2016.

* cited by examiner

LIGHTING ARRANGEMENT

CROSS-REFERENCE TO RELATED PENDING APPLICATIONS

This application is a continuation-in-part of pending U.S. patent application Ser. No. 14/956,416 for a LIGHTING ARRANGEMENT, filed on 2 Dec. 2015, which is hereby incorporated by reference in its entirety. This application also claims the benefit of U.S. Provisional Patent Application Ser. No. 62/210,464 for a LIGHTING ARRANGEMENT, filed on 27 Aug. 2015, which is hereby incorporated by reference in its entirety. This application is also a continuation-in-part of pending U.S. patent application Ser. No. 14/986,760 for a LIGHTING ARRANGEMENT, filed on 4 Jan. 2016, which is hereby incorporated by reference in its entirety.

BACKGROUND

1. Field

The present disclosure relates to lighting fixtures operable to emit light.

2. Description of Related Prior Art

U.S. Pat. No. 8,376,777 discloses a QUICK MOUNTING DEVICE WITH MODULES. The quick mounting device for appliances is alleged to be quickly and easily engaged and disengaged mechanically without the use of tools.

German patent DE4030077 discloses a Ring assembly for built-in ceiling light fitting. The cover ring (30) is arranged in a decorative design, with a cylindrical wall (31) insertable in the mounting ring, and a collar overlapping the outer edge of the mounting ring in the inserted position. The following elements are arranged at the mounting ring: several recesses (13) open to the outside are distributed parallel to the axis over the circumference, for the radial guiding of holding arms (13b) are guided in formed bearing bushes (15); several slots (21) open at the inside are formed in the cylindrical wall distributed over the circumference, dimensioned for the acceptance of axis parallel strip springs, whereby the slots in the form of tangential slits (20) run out in the region of the upper edge; several tongues (18) provided with catches are distributed uniformly in the cylinder wall over the circumference, which by engaging in openings in the cylinder wall of the cover ring, produce a joint with these. The alleged use/advantage of the mounting ring for inbuilt ceiling lights used in suspended ceiling. Lights can be installed in ceiling opening in most simple manner using apt installation engineered parts.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A lighting arrangement can include a mounting ring, a luminaire, a plurality of locking arms, and a plurality of posts. The mounting ring can extend along a central longitudinal axis and can have a plurality of mounting apertures and a circular wall. The circular wall can have an inwardly-facing surface encircling the central longitudinal axis and can define a radial boundary of a cavity. The circular wall can also have an outwardly-facing surface opposite to the inwardly-facing surface, with a thickness of the circular wall defined between the inwardly-facing surface and the outwardly-facing surface. The circular wall can extend a height along the central longitudinal axis between a downwardly-facing surface and an upwardly-facing surface. The luminaire can have a housing assembly and a light emitter. The housing assembly can at least partially enclose the light emitter. The housing assembly can be at least partially received in the cavity. The plurality of locking arms can each be fixedly associated with one of the circular wall and the housing assembly. Each of the plurality of locking arms can include an axial portion extending along the central longitudinal axis and a circumferential portion extending about the central longitudinal axis. Each of the circumferential portions can extend from a first end at an intersection with one of the axial portions to a respective second end distal relative to the first end. Each of the circumferential portions can have an upper face directed in the same direction as the upwardly-facing surface and a lower face directed in the same direction as the downwardly-facing surface. The plurality of posts can each be fixedly associated with the other of the circular wall and the housing assembly. Each of the plurality of posts can extend away from the other of the circular wall and the housing assembly along a respective post axis that intersects the central longitudinal axis. A width of each post can be defined in a direction about the central longitudinal axis. The mounting ring and the luminaire can be interconnected by moving each of the plurality posts past each of the plurality of distal ends along the central longitudinal axis and then rotating the mounting ring and the luminaire relative to one another in a first angular direction about the central longitudinal axis and then sliding each of the plurality of posts along one of the upper and lower faces such that the one of the upper and lower faces thereby defines a sliding surface.

BRIEF DESCRIPTION OF THE DRAWINGS

The detailed description set forth below references the following drawings.

DETAILED DESCRIPTION

Figure 1:
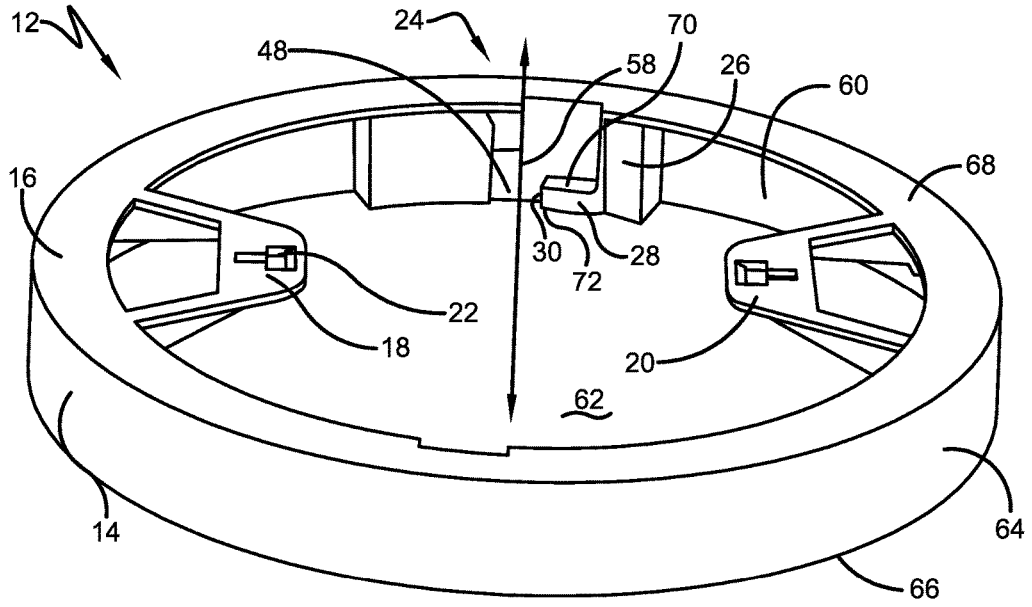
FIG. 1 is a perspective view of a mounting ring according to an exemplary embodiment of the present disclosure.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix or an apostrophe. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The present disclosure, as demonstrated by the exemplary embodiments described below, can provide lighting arrangements that do not require an installer to make additional holes into the ceiling or wall mounting location. Lighting arrangements according to one or more embodiments of the present disclosure can attach directly into a standard junction box used in building construction. Lighting arrangements according to one or more embodiments of the present disclosure can be comprised of components that are attached together without the need for tools.

FIG. 1 is a perspective view of a mounting ring 12 according to an exemplary embodiment of the present disclosure. The mounting ring 12 can extend along a central longitudinal axis 58. The mounting ring 12 can include a cylindrical portion or circular wall 14 and a disk portion 16. Mounting tabs or projections 18, 20 can be engaged with the cylindrical portion 14 through the disk portion 16. The circular wall 14 can interconnect the plurality of tabs 18, 20. Each mounting projection 18, 20 can include a mounting aperture, such as aperture 22, configured to receive a threaded fastener for attaching the mounting ring 12 to a junction box (shown in other figures). As shown in FIG. 1, the mounting apertures, such as aperture 22, are defined in horizontal plane. The circular wall 14 can have an inwardly-facing surface 60 encircling the central longitudinal axis 58, defining a radial boundary of a cavity 62. The circular wall 14 can also have an outwardly-facing surface 64 opposite the inwardly-facing surface 60 with a thickness defined radially, between the inwardly-facing surface 60 and the outwardly-facing surface 64. The circular wall 14 can extend a height along the central longitudinal axis 58 between a downwardly-facing surface 66 and an upwardly-facing surface 68.

The mounting ring 12 can also include one or more locking arms 24 fixedly associated with the circular wall. In other embodiments, the arms could be fixedly associated with the luminaire described below. The exemplary locking arms 24 project radially-inward from the inwardly-facing surface 60 of the cylindrical portion 14. The locking arm 24 can include an axial portion 26 extending along the axis 58 and a circumferential portion 28 extending about the axis 58. Each of the plurality of circumferentially-extending locking arms 24 can project from the circular wall 14 radially relative to the central longitudinal axis 58. Each of the circumferential portions 28 can extend from a first end at an intersection with one of the axial portions 26 to a respective second end 30 distal relative to the first end. Each of the circumferential portions 28 can have an upper face 70 and a lower face 72. Each face 70, 72 may be defined by a plurality of discrete surfaces in one or more implementations of the present disclosure.

Figure 2:
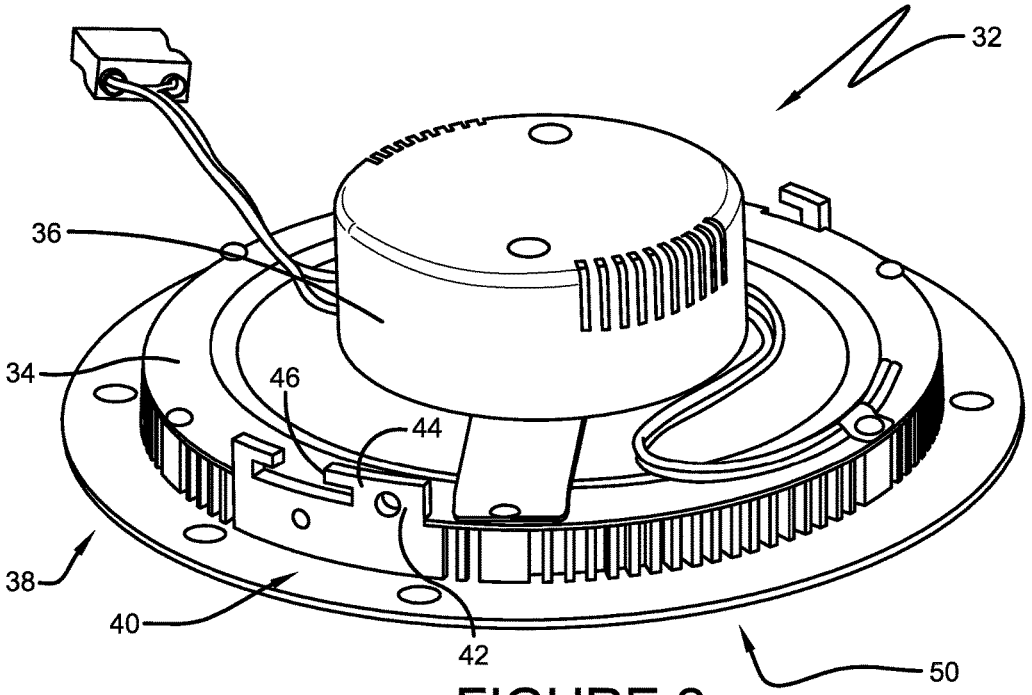
FIG. 2 is a perspective view of a lighting assembly or luminaire according to an exemplary embodiment of the present disclosure.

FIG. 2 is a perspective view of a lighting assembly or luminaire 32 according to an exemplary embodiment of the present disclosure. The lighting assembly 32 can include a housing assembly 34 containing light emitters and circuitry for driving the light emitters, including any power and ac/dc conversion circuitry. Some circuitry can be mounted in a housing 36 attached to the housing assembly 34, such as transformer. The housing 36 can be sized to fit within a junction box. The housing assembly 34 can be sized to be at least partially received in the cavity 62.

The housing assembly 34 can be fixedly engaged with a plurality of posts 40. Each of the plurality of posts 40 can extend away from the housing assembly 34 along the axis 58. The posts 40 could extend from the circular wall in other embodiments of the present disclosure and locking arms could be fixedly engaged with the housing assembly 34. Each of the plurality of posts can be fixedly associated with one of the circular wall 14 and the luminaire 32. Each of the plurality of posts 40 can extend away the structure to which it is fixedly mounted along a respective post axis that intersects the central longitudinal axis 58. A width of each post 40 can be defined in a direction about the central longitudinal axis 58.

The housing assembly 34 and housing 36 can be interconnected to one another through a covering ring 38 of the exemplary lighting assembly 32. The covering ring 38 defines the posts 40. Each of the exemplary posts 40 can have an axial portion 42 and a circumferential portion 44. The circumferential portion 44 projects transverse to the axial portion 42 to a distal end 46. The exemplary posts 40 extend away the structure to which they are fixedly mounted along a respective post axis that extend about the central longitudinal axis 58.

After the mounting ring 12 has been mounted to a junction box at the desired location for lighting, the lighting assembly 32 can be received in the circular wall 14 to form the lighting arrangement 10. The mounting ring 12 and the luminaire 32 can be interconnected by moving each of the plurality posts 40 past each of the plurality of distal ends 30 along the central longitudinal axis 58 and rotating the mounting ring 12 and the luminaire 32 relative to one another in a first angular direction about the central longitudinal axis 58. The axial portion 44 can be received in a gap referenced at 48. The lighting assembly 32 can then be rotated relative to the mounting ring 12 until the distal end 46 contacts the axial portion 26 and/or until the distal end 30 contacts the axial portion 42. The mounting ring 12 and the lighting assembly 32 are thus assembled for use and an exemplary lighting arrangement is formed. A surface referenced at 50 of the covering ring 38 conceals the mounting ring 12 from view.

Figure 3:
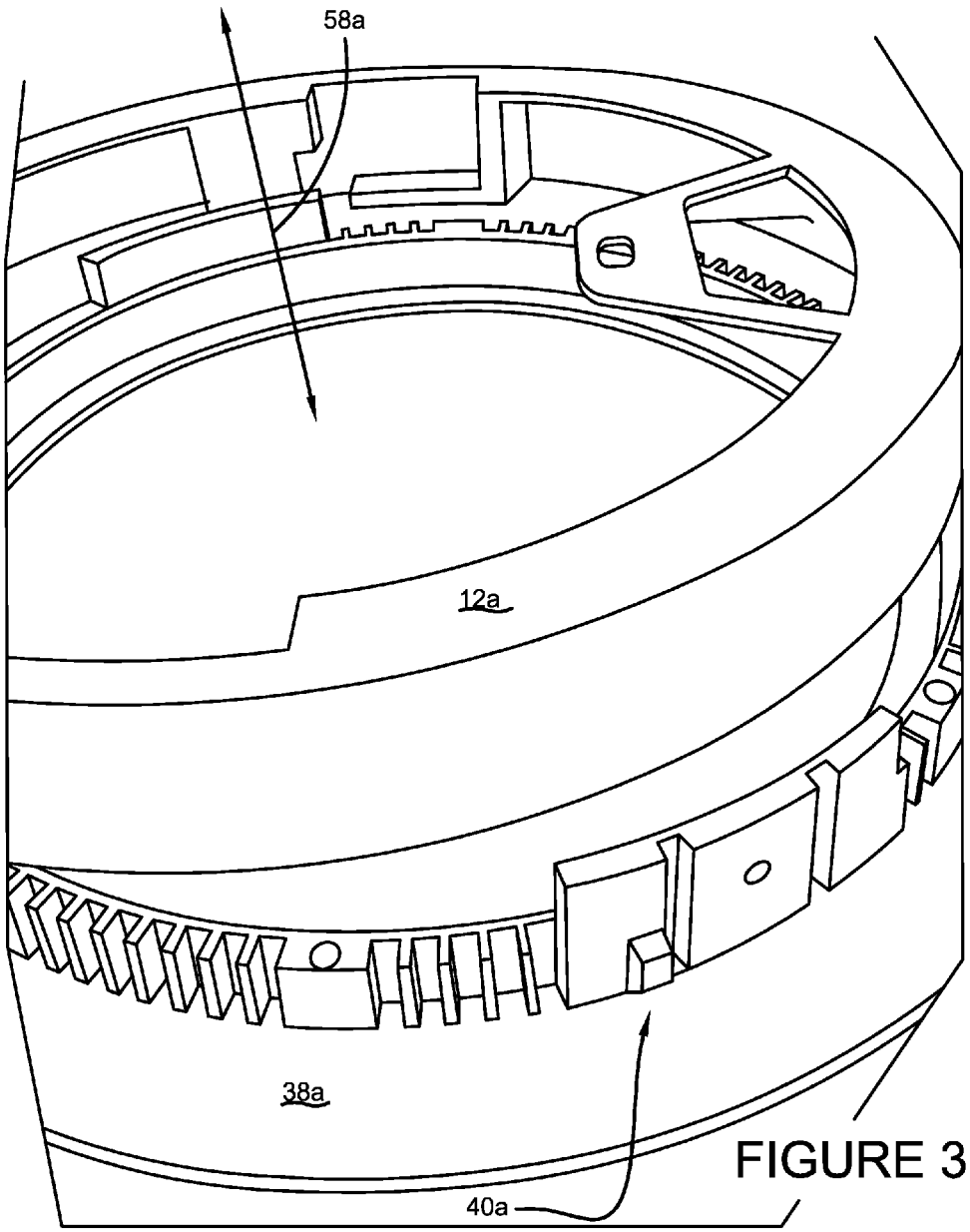
FIG. 3 is a perspective view of the mounting ring and a covering ring according to an exemplary embodiment of the present disclosure.

FIG. 3 is a perspective view of a mounting ring 12*a* and a covering ring 38*a* in the process of being assembled according to an exemplary embodiment of the present disclosure. The remaining portions of the housing assembly have been omitted to better display the structures of the mounting ring 12*a* and the covering ring 38*a*. The post 40 has been replaced with a post 40*a* in the form of a polygonal tab. The post 40*a* extends radially outward relative to a central longitudinal axis 58*a* along an axis that intersects the axis 58*a*, rather than about the central longitudinal axis 58 like the posts 40.

Figure 4:
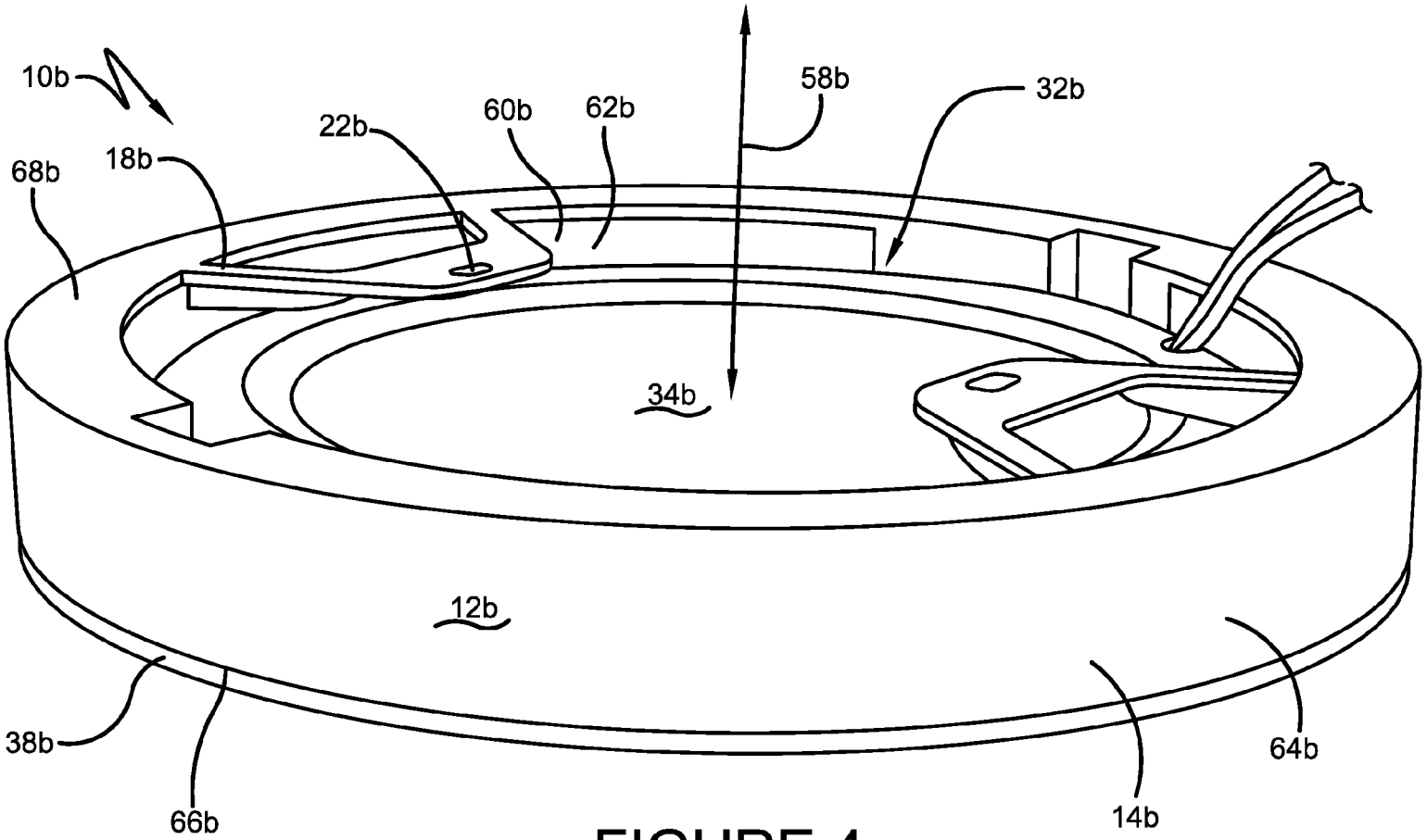
FIG. 4 is a perspective view of a lighting arrangement according to an exemplary embodiment of the present disclosure.

FIG. 4 is a perspective view of a lighting arrangement 10*b* according to an exemplary embodiment of the present disclosure. The lighting arrangement 10*b* includes a mounting ring 12*b*. A covering ring 38*b* is also illustrated. The lighting arrangement 10*b* includes an alternative housing assembly 34*b* that does not protrude above the mounting ring 12*b*. The housing assembly 34*b* can include all of the components contained in the housing assembly 36 and the housing 36 of the first embodiment. The lighting arrangement 10*b* includes an embedded driver arrangement as disclosed in of pending U.S. patent application Ser. No. 14/986,760 for a LIGHTING ARRANGEMENT, filed on 4 Jan. 2016, which is hereby incorporated by reference in its entirety.

Figure 6:
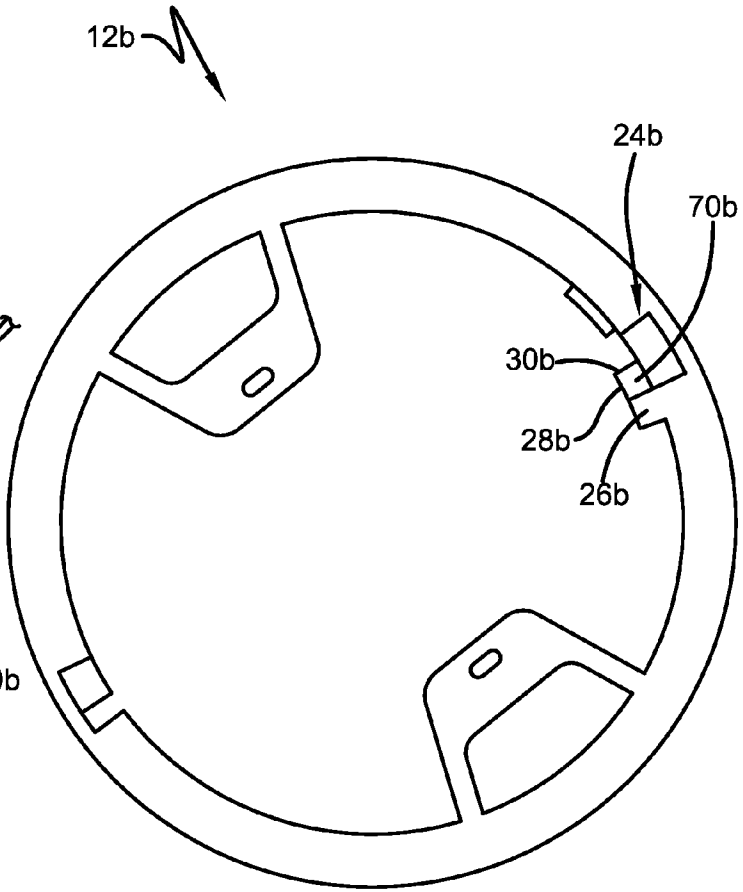
FIG. 6 is a top view of the mounting ring shown in FIG. 4.
Figure 5:
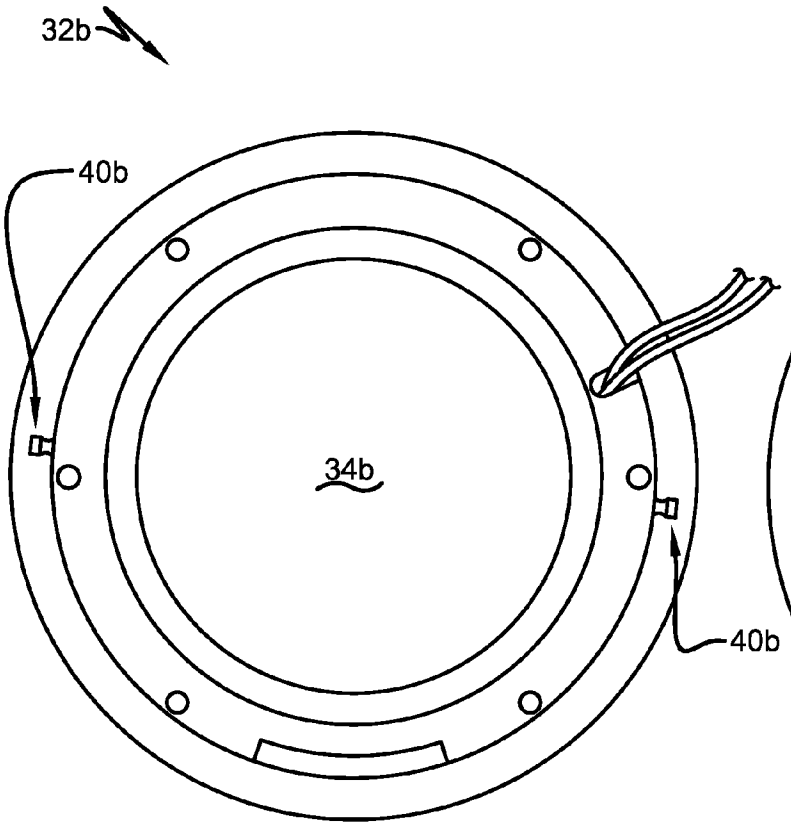
FIG. 5 is a top view of the luminaire shown in FIG. 4.

FIG. 5 is a top view of a lighting assembly or luminaire 32*b* according to an exemplary embodiment of the present disclosure. The exemplary lighting assembly 32*b* is a component of the exemplary lighting arrangement 10*b* shown in FIG. 4. FIG. 6 is a top view of the mounting ring 12*b* according to an exemplary embodiment of the present disclosure.

With reference to FIGS. 4-6, the mounting ring 12*b* can extend along a central longitudinal axis 58*b* and have a plurality of tabs, such as tab 18*b*. The mounting ring 12*b* can also have a circular wall 14*b* and a plurality of locking arms 24*b*. Each of the plurality of tabs 18*b* can define a mounting aperture, such as mounting aperture 22*b*. The circular wall 14*b* can interconnect the plurality of tabs 18*b*. The circular wall 14*b* can have an inwardly-facing surface 60*b* encircling the central longitudinal axis 58*b* and defining a cavity 62*b*. The circular wall 14*b* can also have an outwardly-facing surface 64*b* opposite the inwardly-facing surface 60*b* with a thickness defined radially between the inwardly-facing surface 60*b* and the outwardly-facing surface 64*b*. The circular wall 14*b* can extend a height along the central longitudinal axis 58*b* between a downwardly-facing surface 66*b* and an upwardly-facing surface 68*b*.

It is noted that "downwardly" and "upwardly" are used herein for reference and are not limiting on the scope of the present disclosure and possible embodiments thereof.

Each of the plurality of circumferentially-extending locking arms 24*b* can project from the circular wall 14*b* radially relative to the central longitudinal axis 58*b*. Each of the plurality of locking arms 24*b* can include an axial portion 26*b* extending along the central longitudinal axis 58*b* and a circumferential portion 28*b* extending about the central longitudinal axis 58*b*. Each of the circumferential portions 28*b* can extend from a first end at an intersection with one of the axial portions 26*b* to a respective second end 30*b* distal relative to the first end. Each of the circumferential portions 28*b* can have an upper face 70*b* and a lower face (not visible in FIGS. 4-6). At least one of the faces can be defined by a plurality of discrete surfaces in one or more implementations of the present disclosure.

The luminaire 32*b* can include the housing assembly 34*b*, one or more light emitters (not visible), and a plurality of posts 40*b*. The housing assembly 34*b* can at least partially enclose the light emitter. The exemplary housing assembly 34*b* can be fully received in the cavity 62*b*. Each of the plurality of posts 40*b* can extend away from the housing assembly 34*b*. The width of each post 40*b* can be defined in a direction about the axis 58*b*. The mounting ring 12*b* and the luminaire 32*b* can be interconnected by moving each of the plurality posts 40*b* past each of the plurality of distal ends 30*b* along the central longitudinal axis 58*b* and rotating the mounting ring 12*b* and the luminaire 32*b* relative to one another in a first angular direction about the central longitudinal axis 58*b*.

Figure 8:
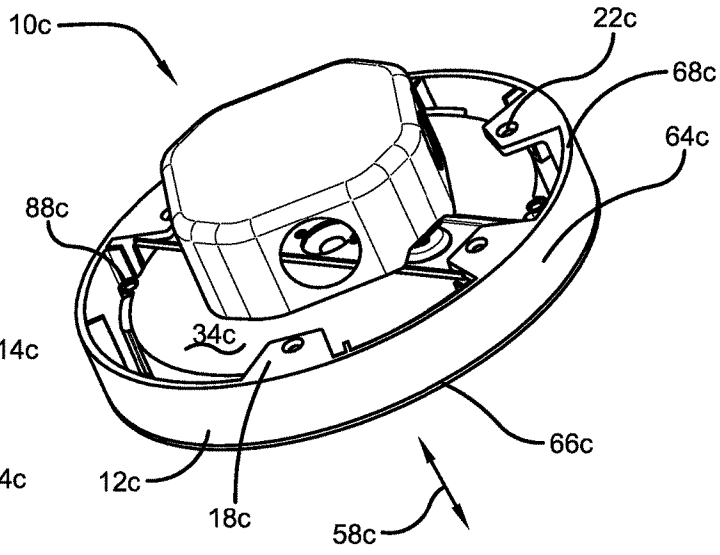
FIG. 8 is a perspective assembly view the exemplary embodiment of the present disclosure shown in FIG. 7.
Figure 7:
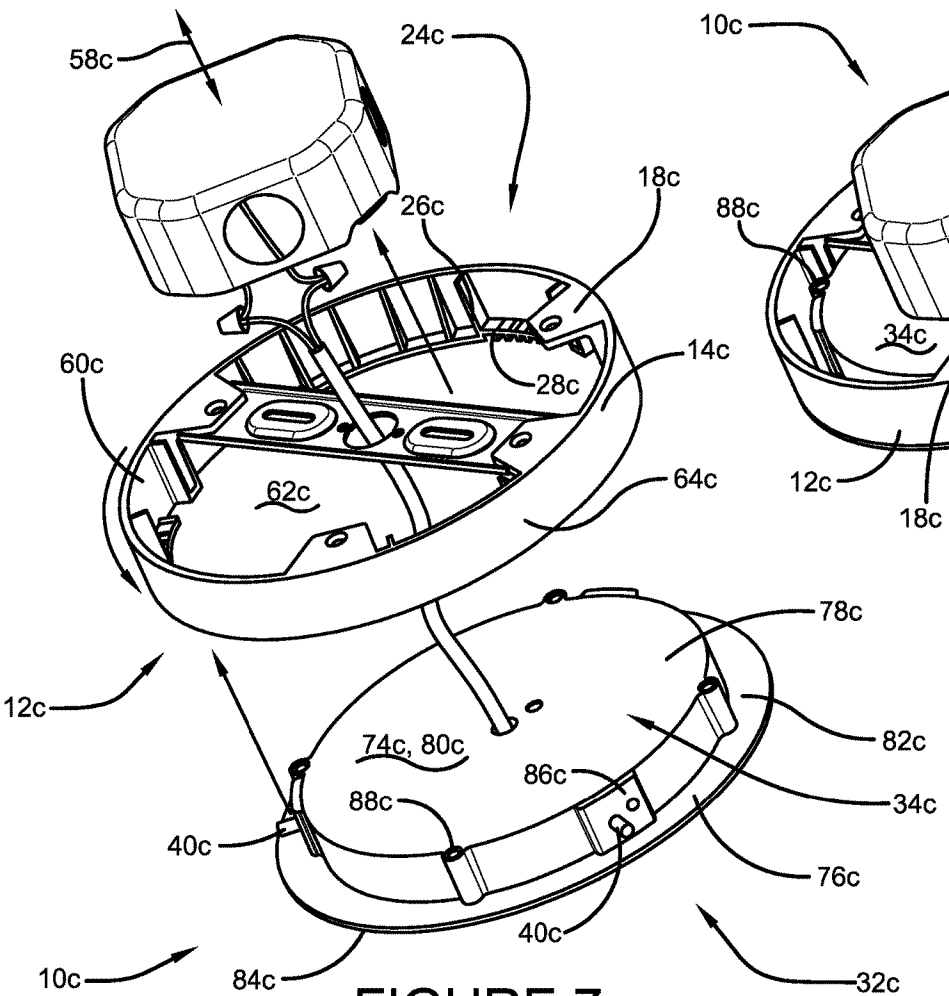
FIG. 7 is an exploded view of another exemplary embodiment of the present disclosure.
Figure 9:
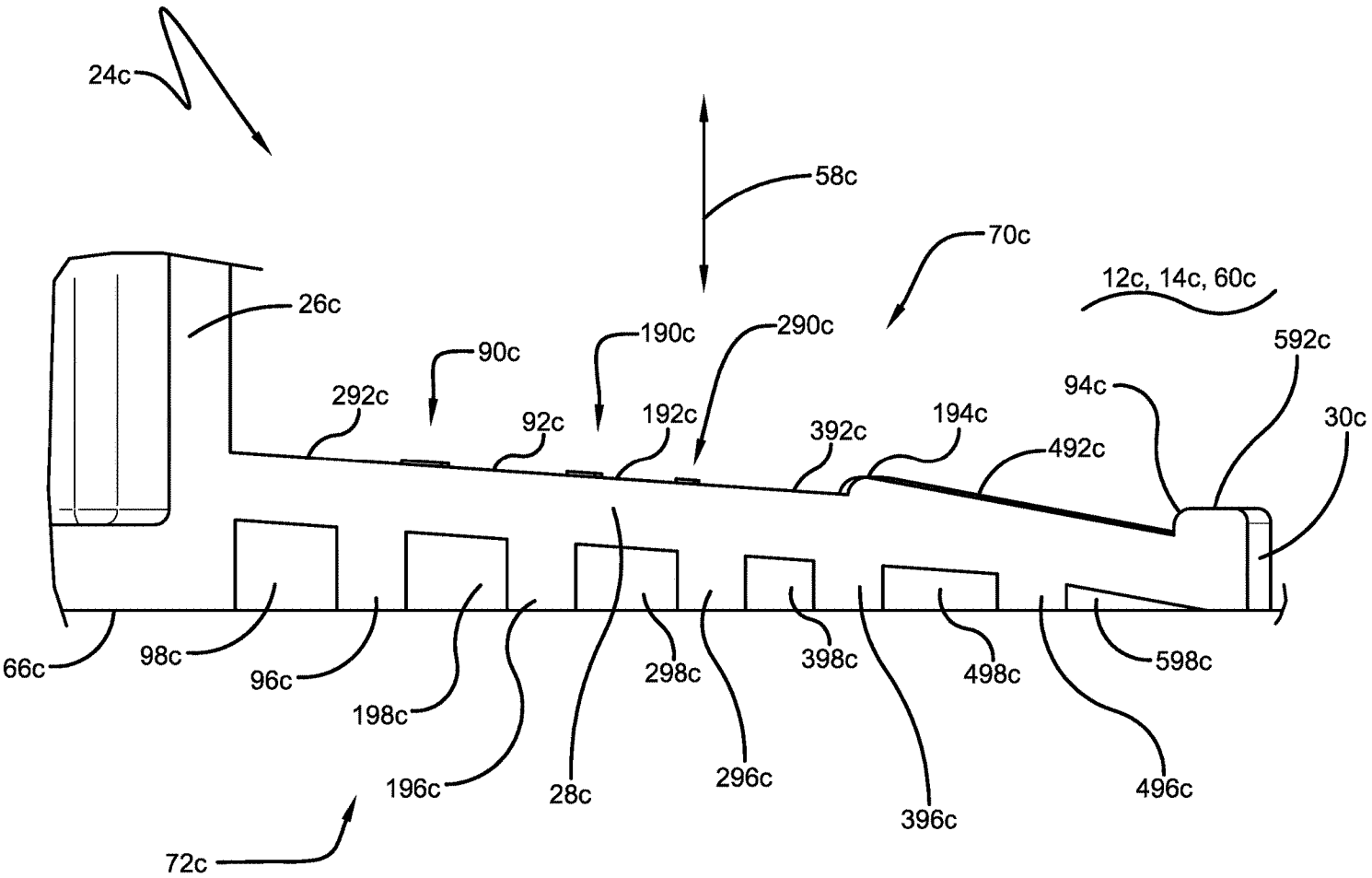
FIG. 9 is a side profile view of a locking arm of the exemplary embodiment of the present disclosure shown in FIGS. 7 and 8 from the perspective of a central longitudinal axis.

In other embodiment of the present disclosure, shown in FIGS. 7-9, a lighting arrangement 10*c* can include a mounting ring 12*c* and a luminaire 32*c*. The mounting ring 12*c* can extend along a central longitudinal axis 58*c* and have a plurality of tabs 18*c*. The mounting ring 12*c* can be affixed to a junction box 65*c*, which can be mounted above a ceiling and be accessible through a hole in the ceiling. The mounting ring 12*c* can also have a circular wall 14*c* and a plurality of locking arms 24*c*. The mounting ring 12*c* can be received in the hole in the ceiling and be flush with the ceiling or can be positioned on the surface of the ceiling. Each of the plurality of tabs 18*c* can define a mounting aperture 22*c*. The circular wall 14*c* can interconnect the plurality of tabs 18*c*. The circular wall 14*c* can have an inwardly-facing surface 60*c* encircling the central longitudinal axis 58*c* and defining a cavity 62*c*. The circular wall 14*c* can also have an outwardly-facing surface 64*c* opposite the inwardly-facing surface 60*c* with a thickness defined between the inwardly-facing surface 60*c* and the outwardly-facing surface 64*c*. The circular wall 14*c* can extend a height along the central longitudinal axis 58*c* between a downwardly-facing surface 66*c* and an upwardly-facing surface 68*c*.

As best shown in FIG. 9, each of the plurality of circumferentially-extending locking arms 24*c* can project from the circular wall 14*c* radially relative to the central longitudinal axis 58*c*. The exemplary arms 24*c* project radially inward, but could project radially outward in other implementations of the present disclosure or could be defined by the circular wall 14. Each of the plurality of locking arms 24*c* can include an axial portion 26*c* extending along the central longitudinal axis 58*c* and a circumferential portion 28*c* extending about the central longitudinal axis 58*c*. Each of the circumferential portions 28*c* can extend from a first end at an intersection with one of the axial portions 26*c* to a respective second end 30*c* distal relative to the first end. Each of the circumferential portions 28*c* can have an upper face 70*c* and a lower face 72*c*. One or both of the faces 70*c*, 72*c* can be defined by a plurality of discrete surfaces in one or more implementations of the present disclosure.

The luminaire 32*c* can include a housing assembly 34*c* and a light emitter and a plurality of posts 40*c*. The housing assembly 34*c* can at least partially enclose the light emitter. The light emitter can be one or more light emitting diode, such as shown in other embodiments set forth herein. The exemplary housing assembly 34*c* can be fully received in the cavity 62*c*. Each of the plurality of posts 40*c* can extend away from the housing assembly 34*c*. The mounting ring 12*c* and the luminaire 32*c* can be interconnected by moving each of the plurality posts 40*c* past each of the plurality of distal ends 30*c* along the central longitudinal axis 58*c* and rotating the mounting ring 12*c* and the luminaire 32*c* relative to one another in a first angular direction about the central longitudinal axis 58*c*.

The exemplary housing assembly 34*c* can include a body portion 74*c* and a flange portion 76*c*. The body portion 74*c* can extend between top end 78*c* and a bottom end 80*c* along the central longitudinal axis 58*c*. The exemplary body portion 74*c* is fully disposed in the cavity 62*c*. The body portion 74*c* can extend along the central longitudinal axis 58*c* between the downwardly-facing surface 66*c* of the circular wall 14*c* and the plurality of tabs 18*c*. The body portion 74*c* can have a variable thickness, with thicker portions (such as referenced at 86*c*) surrounding each of the plurality of posts 40*c*. The flange portion 76*c* can extend radially-outward from the body portion 74*c* and have an upwardly-facing surface 82*c* and a downwardly-facing surface 84*c*. The upwardly-facing surface 82*c* of the flange portion 76*c* can abut and contact the downwardly-facing surface 66*c* of the circular wall 14*c* around a continuous circumference about the central longitudinal axis 58*c* in some implementations, as shown in FIG. 8. A diameter of the flange portion 76*c* can be substantially equal to a diameter of the outwardly-facing surface 64*c* of the circular wall 14*c* and thus flush with the outwardly-facing surface 64*c*.

The exemplary housing assembly 34*c* can also include a canister portion positioned in the body portion 74*c*. The light emitters can be disposed in the canister portion. The canister portion and the body portion 74*c* can be interconnected with fasteners 88*c*.

FIG. 9 is a side profile view of the locking arm 24*c* from the perspective of the central longitudinal axis 58*c*. As shown, the exemplary upper face 70*c* defines a profile having a plurality of discrete surfaces. The illustration of the profile 24*c* shows a series of notched edges, a plurality of distinct surfaces delineated by distinct edges. The exemplary edges are defined by a plurality of protuberances 90*c*, 190*c*, 290*c*, with planar surface portions 92*c*, 192*c* defined between adjacent pairs of protuberances and other planar surface portions 292*c*, 392*c*, 492*c*, 592*c*.

The posts 40*c* can ride along the upper face 70*c* during assembly of the lighting arrangement 10*c*. The engagement between the posts 40*c* and the protuberances 90*c*, 190*c*, 290*c* and the surfaces 92*c*, 192*c*, 292*c*, 392*c*, 492*c*, 592*c* provide the assembler (typically a consumer) tactile and/or audible detection of connection during relative rotation between the lighting arrangement 32*c* and the mounting ring 12*c*. This allows the assembler to feel the progress of assembly. Further, the arrangement of the protuberances 90*c*, 190*c*, 290*c* and the surfaces 92*c*, 192*c*, 292*c*, 392*c*, 492*c*, 592*c* allow the lighting arrangement 32*c* to be positioned in a plurality of different angular positions relative to the mounting ring 12*c*. The post 40*c* can be stably maintained between two of the protuberances 90*c*, 190*c*, 290*c* or against one of the protuberances 90*c*, 190*c*, 290*c*.

In the Figures, the lighting arrangement 32*c* is unadorned, but embodiments can be practiced with decorative features and indicia and a precise angular of the lighting arrangement 32*c* relative to the mounting ring 12*c* can be desirable. Engagement between the posts 40*c* and the protuberances 90*c*, 190*c*, 290*c* can generate a click or another noise so that the assembler is advised of progress or advised of one possible "final" position for the lighting arrangement 32*c*. For example, the first click can inform the assembler that the lighting arrangement 32*c* is acceptably engaged with the mounting ring 12*c*. The assembler can further rotate the lighting arrangement 32*c* if desired. Embodiments can include more than three protuberances 90*c*, 190*c*, 290*c*. The gaps between protuberances 90*c*, 190*c*, 290*c* (the circumference length of the surface portions 92*c*, 192*c*) can be constant or variable. For example, the gaps between protuberances 90*c*, 190*c*, 290*c* (defined by the angular length of surface areas 92*c*, 192*c*, 292*c*, 392*c*) can shorten as rotation of the lighting arrangement 32*c* progresses.

The upper face 70*c* can also include a plurality of surface portions 94*c*, 194*c* that are concave relative to the first angular direction. The exemplary surface portions 94*c*, 194*c* are rounds to allow the posts 40*c* (and luminaire 32*c*) to gently transition during sliding between surfaces at different heights. The direction of rotation and movement of the posts 40*c* during assembly for an exemplary embodiment is referenced at 95*c*. Specifically, in one or more embodiments, the mounting ring 12*c* can be fixed and the lighting arrangement 32*c* can be rotated in the direction 95*c* to engage the lighting arrangement 32*c* with the mounting ring 12*c*. The post 40*c* can ride along the surface portion 592*c* of the upper face 70*c* during assembly of the lighting arrangement 10*c* and ride over the surface portion 94*c* which is concave relative to the direction 95*c*. The movement of the post 40*c* over the surface portion 94*c* can generate a pronounced click or hand-feel (tactile indication). The concave surface portions 94*c*, 194*c* along with the protuberances 90*c*, 190*c*, 290*c* can cause different noises or tactile sensations that can assist the assembler during assembly. The surface portion 94*c* is downstream of the flat surface portion 592*c*. The surface portion 194*c* is fed by the ramp surface portion 492*c*. Thus, the order of flat, ramped and concave surface portions can be varied to simplify installation for the assembler.

The lower face 72*c* of the locking arm 24*c* defines a stepped profile. The stepped profile includes a plurality of steps 96*c*, 196*c*, 296*c*, 396*c*, 496*c* and a plurality of gaps 98*c*, 198*c*, 298*c*, 398*c*, 498*c*, 598*c* between adjacent steps. The circumferential width of the steps 96*c*, 196*c*, 296*c*, 396*c*, 496*c* can be variable or constant. The circumferential width of the gaps 98*c*, 198*c*, 298*c*, 398*c*, 498*c*, 598*c* can be variable or constant. It can be desirable to vary the circumferential widths in that variation can provide an indication of the distal end 30 for the assembler. The mounting ring 12*c* can be installed in a wall or ceiling and the pattern of steps and gaps can provide an indication to the assembler of the location of the locking arms 24*c*. In the exemplary embodiment, the widths of gaps 498*c* and 598*c* are greater than the width of gaps 98*c*, 198*c*, 298*c*, and 398*c*. Further the width of gap 398*c* is less than the widths of the remaining gaps 198*c*, 298*c*, 398*c*, 498*c*, 598*c*. The mounting ring 12*c* can be formed such that downwardly-facing surface 66*c* is planar and uninterrupted except for the pattern of gaps 98*c*, 198*c*, 298*c*, 398*c*, 498*c*, 598*c* to assist the assembler in quickly and easily identifying the location for inserting the posts 40*c*.

The arrangement of the steps 96*c*, 196*c*, 296*c*, 396*c*, 496*c* and the gaps 98*c*, 198*c*, 298*c*, 398*c*, 498*c*, 598*c* renders the thickness of the plurality of locking arms 24, as defined along the central longitudinal axis 58*c*, to be variable. This allows for some bending of the locking arm 24*c* during installation. Bending of the locking arm 24*c* can enhance the tactile or noise response when the posts 40*c* engage features of the upper face 70*c*.

The post 40*c* slides along the upper face 70*c* when the luminaire 32*c* and the mounting ring 12*c* are interconnected. The exemplary sliding surface defined by upper face 70*c* includes a first area that has been referenced already as surface 392*c*. The first area can be substantially flat (as well as slightly ramped) in side profile (shown in FIG. 9) and extends a first arcuate length about the central longitudinal axis 58*c*. The first arcuate length is referenced at 21*c* in FIG. 16. The exemplary sliding surface defined by upper face 70*c* also includes a second area that has been referenced already as surface 192*c*. The second area can be substantially flat in side profile and extends a second arcuate length about the central longitudinal axis 58*c*. The second arcuate length is referenced at 23*c* in FIG. 16.

The exemplary sliding surface defined by upper face 70*c* also includes at least one protuberance creating a gap between the first area and the second area. A protuberance is a structural feature, more than an edge line, as it defines a gap between the first and second areas. In various embodiments of the present disclosure, a protuberance can be positive or negative. A positive protuberance can extend above and can be elevated over the first area and the second area with respect to the central longitudinal axis 58*c*. A negative protuberance could extend below and be vertically recessed with respect to the first area and the second area relative to the central longitudinal axis 58*c*.

Figure 16:
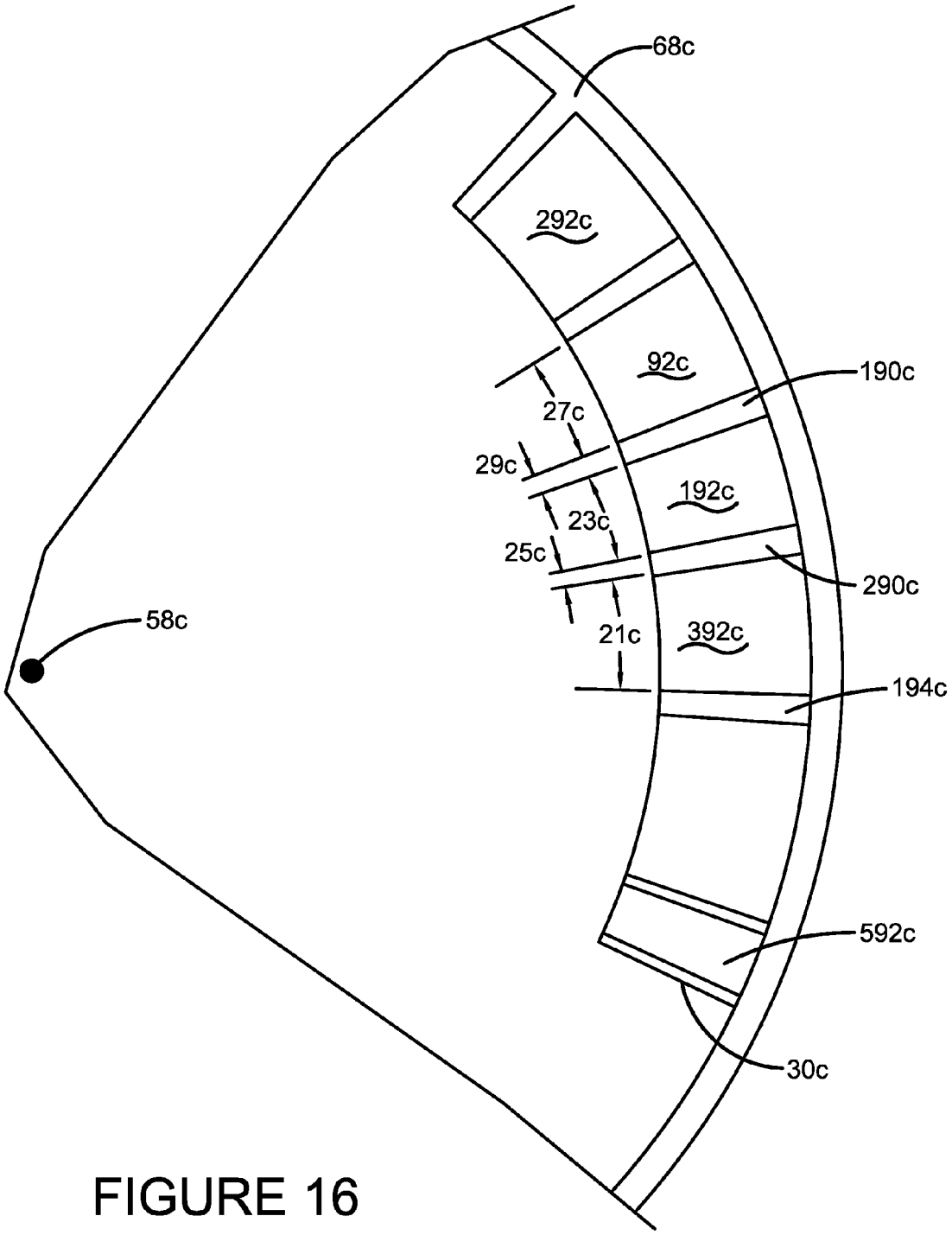
FIG. 16 is a top-down view of a portion of the structures shown in FIGS. 7-9.

Referring now to FIG. 16, a protuberance has already been referenced at 290*c*. The exemplary protuberance 290*c* is positive. The protuberance 290*c* can extend a third arcuate length about the central longitudinal axis 58*c* and is referenced at 25*c*. The third arcuate length 25*c* is less than both of the first arcuate length 21*c* and the second arcuate length 23*c*.

The exemplary sliding surface defined by upper face 70*c* also includes a third area that has been referenced already as surface 92*c*. The third area can be substantially flat in side profile and can extend a fourth arcuate length about the central longitudinal axis 58*c*. The fourth arcuate length is referenced at 27*c*.

The exemplary sliding surface defined by upper face 70*c* also includes a second protuberance that has been referenced already at 190*c*. The exemplary protuberance 190*c* is positive and extends a fifth arcuate length about the central longitudinal axis 58*c*. The fifth arcuate length is referenced at 29*c*. The exemplary fifth arcuate length 29*c* is less than both of the second arcuate length 23*c* and the fourth arcuate length 27*c*.

The post 40*c* is configured to be capable of sliding over the first area 392*c*, the protuberance 290*c*, the second area 192*c*, the protuberance 190*c*, and the third area 92*c* when the luminaire 32*c* and the mounting ring 12*c* are interconnected. Of course, the extent that the post 40*c* slides across the upper face 70*c* is at the discretion of the user. When the post 40*c* encounters and slides across one of the protuberances 190*c*, 290*c* as the luminaire 32*c* is being engaged with the mounting ring 12*c*, the user will feel the contact and/or hear a click.

Figure 10:
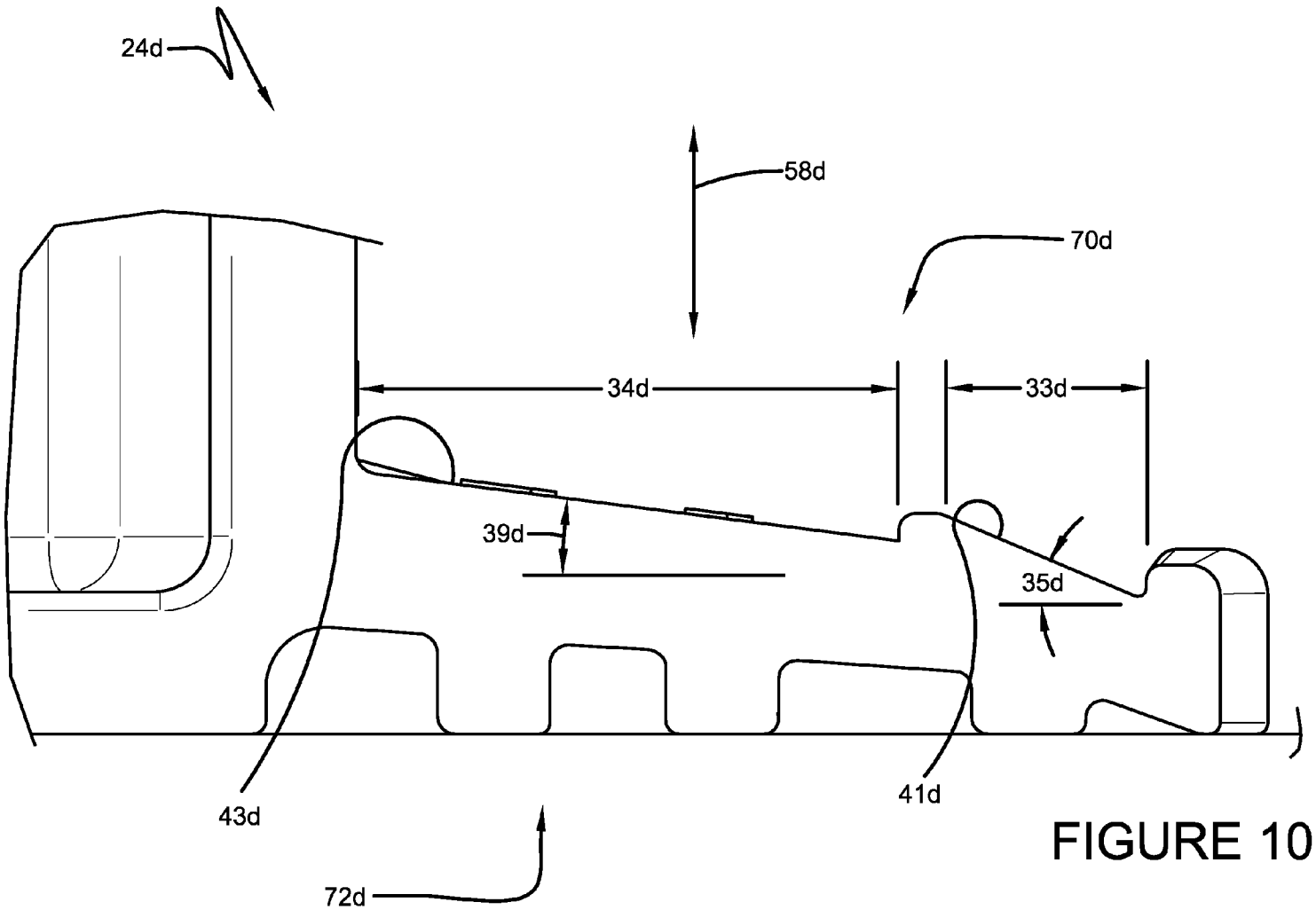
FIG. 10 is a side profile view of a locking arm of another exemplary embodiment of the present disclosure.

FIG. 10 is a side profile view of a locking arm 24*d* of another exemplary embodiment of the present disclosure from the perspective of a central longitudinal axis 58*d*. The locking arm 24*d* includes an upper face 70*d* and a lower face 72*d*. The upper face 70*d* defines a plurality of discreet planar surfaces with protuberances defined between the surfaces. The locking arm 24*d* defines a more compact upper face 70*d* than the upper face 70*c*.

The upper face 70*d* includes a first ramp portion 41*d* and a second ramp portion 43*d*. The first ramp portion 41*d* has a first rate of incline and extends about the central longitudinal axis 58*d* a first angular distance 33*d*. It is noted that from the perspective of FIG. 10 (taken from the axis 58*d*) the angular distance appears straight and not angular, but would appear angular if viewed from above, such as the perspective of FIG. 16. The first rate of incline is referenced at 35*d*. The second ramp portion 43*d* has a second rate of incline and extends about the central longitudinal axis 58*d* a second angular distance 37*d*. The second rate of incline is referenced at 39*d*. In the exemplary embodiment, the second rate 39*d* of incline is less than the first rate 35*d* of incline and the first angular distance 33*d* is less than the second angular distance 37*d*. A post engages the first ramp portion 41*d* before the second ramp portion 43*d* during assembly of a luminaire to a mounting ring. This variation in ramp incline and angular distance communicates to the installer an extent of connection. The shorter, steeper ramp conveys to the installer that the mounting ring and luminaire are substantially interconnected while the longer, gentler ramp allows for fine-tuning of the position of the luminaire relative to mounting ring and to the operating environment.

Figure 11:
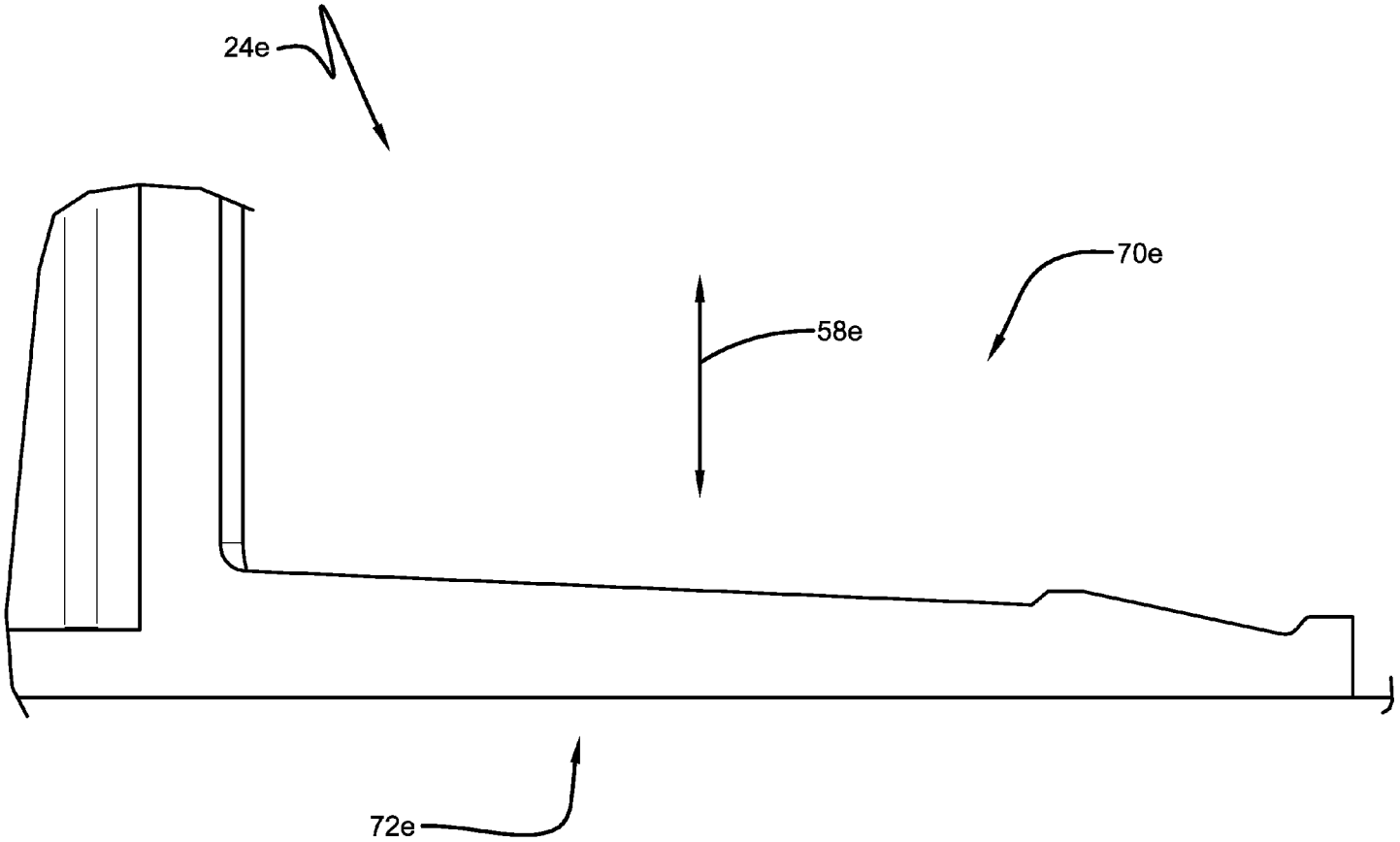
FIG. 11 is a side profile view of a locking arm of another exemplary embodiment of the present disclosure.

FIG. 11 is a side profile view of a locking arm 24*e* of another exemplary embodiment of the present disclosure from the perspective of a central longitudinal axis 58*e*. The locking arm 24*e* includes an upper face 70*e* and a lower face 72*e*. The upper face 70*e* defines a plurality of discreet planar surfaces with edges defined between the surfaces. The upper face 70*e* does not include protuberances but is longer than the upper face 70*c* and defines ramped surface portions of smaller slope that the ramp surface portions 392*c*, 492*c* of the upper face 70*c*. This profile can be desirable in that it provides a surface more amenable to infinite, stable positioning, since the posts cannot be positioned on the precise edges of protuberances and steep ramps can tend to permit the posts to slide down the ramp surface, albeit slowly over time.

Figure 12:
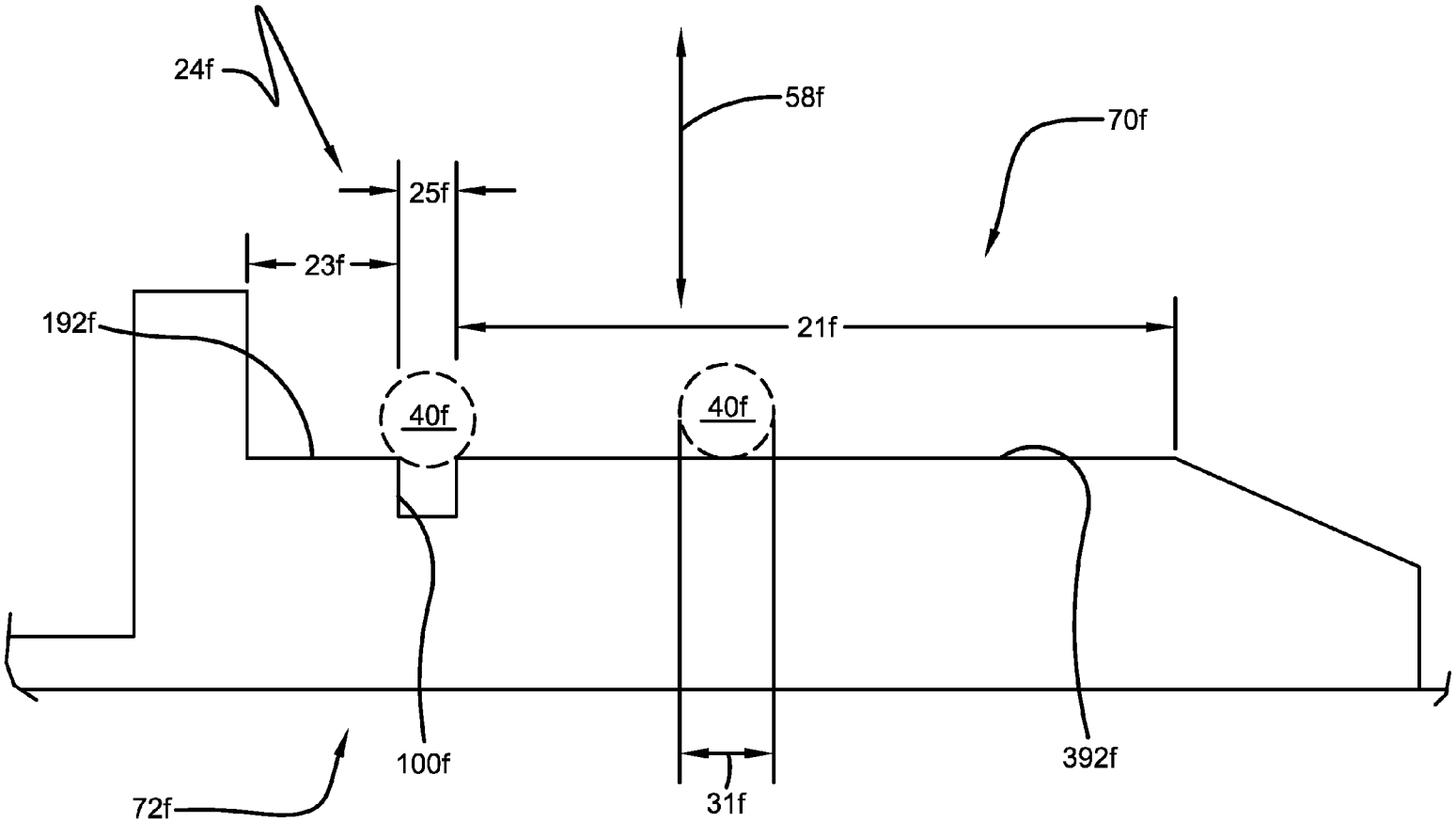
FIG. 12 is a side profile view of a locking arm of another exemplary embodiment of the present disclosure.

FIG. 12 is a side profile view of a locking arm 24*f* of another exemplary embodiment of the present disclosure from the perspective of a central longitudinal axis 58*f* The locking arm 24*f* includes an upper face 70*f* and a lower face 72*f* The upper face 70*f* defines a plurality of discreet planar surfaces with a protuberance defined between the surfaces.

A post 40*f* (shown in phantom in two different positions) can have a width 31*f* and slide along the upper face 70*f* when a luminaire and a mounting ring are interconnected. The exemplary sliding surface defined by upper face 70*f* includes a first area 392*f* The first area 392*f* can be substantially flat in side profile (and non-ramped) and extend a first arcuate length about the central longitudinal axis 58*f*. The first arcuate length is referenced at 21*f*. The exemplary sliding surface defined by upper face 70*f* also includes a second area 192*c*. The second area can be substantially flat in side profile and extend a second arcuate length 23*f* about the central longitudinal axis 58*c*.

The upper face 70*f* also defines a negative protuberance 100*f* for receiving and releasibly capturing the post 40*f* The protuberance 100*f* can create a gap between the first area 392*f* and the second area 192*f*, the gap defined by the width of the protuberance 100*f*. The exemplary negative protuberance 100*f* extends below and is vertically recessed with respect to the first area 392*f* and the second area 192*f* relative to the central longitudinal axis 58*f* The protuberance 290*f* can extend a third arcuate length (a width) about the central longitudinal axis 58*f* and referenced at 25*f*. The third arcuate length 25*f* is less than both of the first arcuate length 21*f* and the second arcuate length 23*f*.

The post 40*f* is configured to slide over the first area 392*f* and "drop" partially into the protuberance 100*f* when the luminaire and the mounting ring are interconnected. The user will sense when this occurs, since the luminaire will drop slightly. The width 31*f* of the post 40*f* is greater than the third arcuate length 25*f*, so the post 40*f* will not fully drop into the negative protuberance 100*f*. In other embodiments, a plurality of negative protuberances could be defined in the upper face 70*f*.

Referring again to FIGS. 7-9, the exemplary posts 40*c* extend only radially outward from the central longitudinal axis 58*c*. Alternatively, the posts 40 of the embodiment show in FIGS. 1 and 2 extend in multiple directions relative to the central longitudinal axis 58. The posts 40 extend upward along the central longitudinal axis 58 a first predetermined distance and circumferentially a second predetermined distance about the central longitudinal axis 58.

Figure 13:
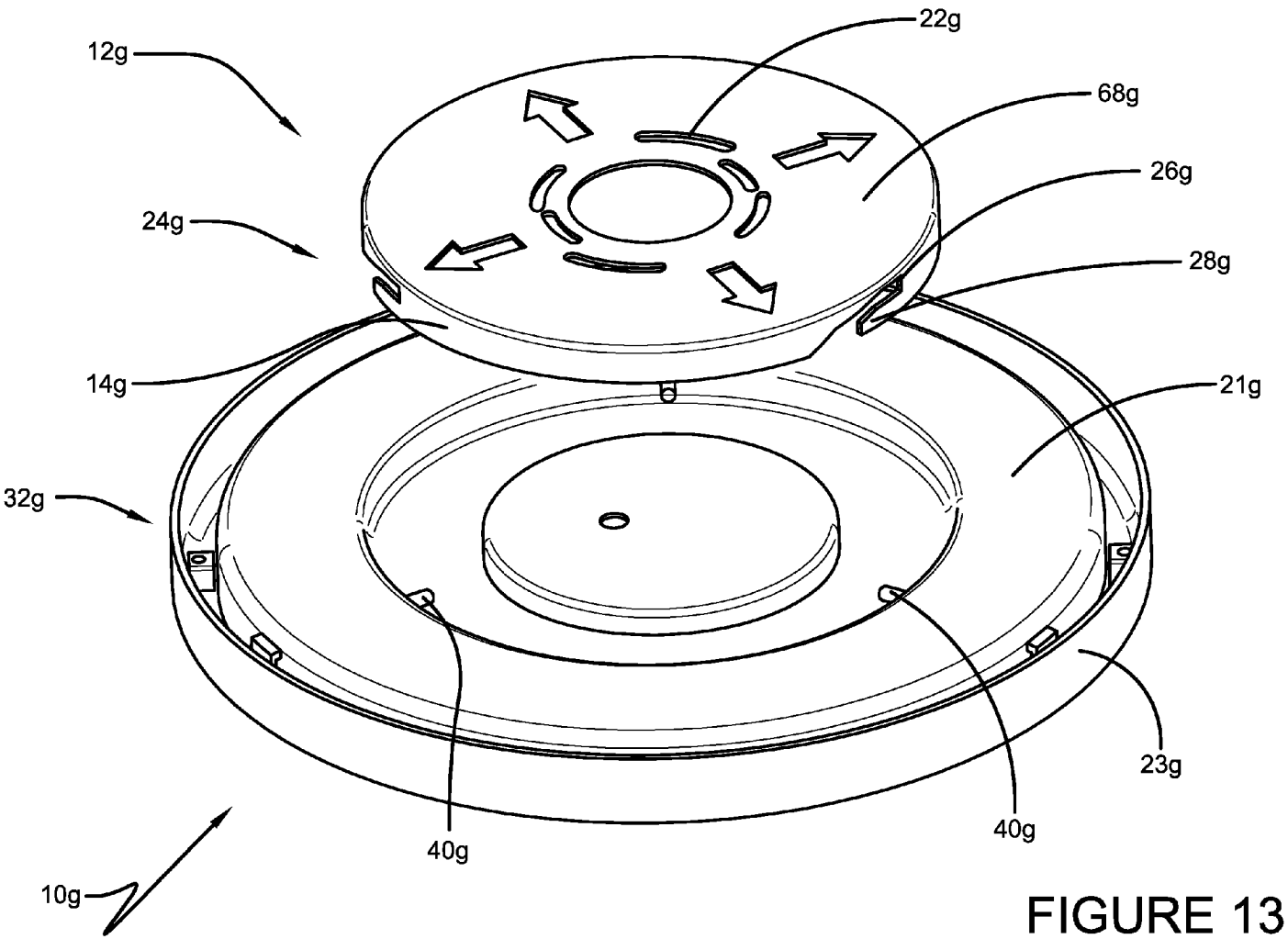
FIG. 13 is a first, partially-exploded view of a lighting assembly according to another exemplary embodiment of the present disclosure.
Figure 14:
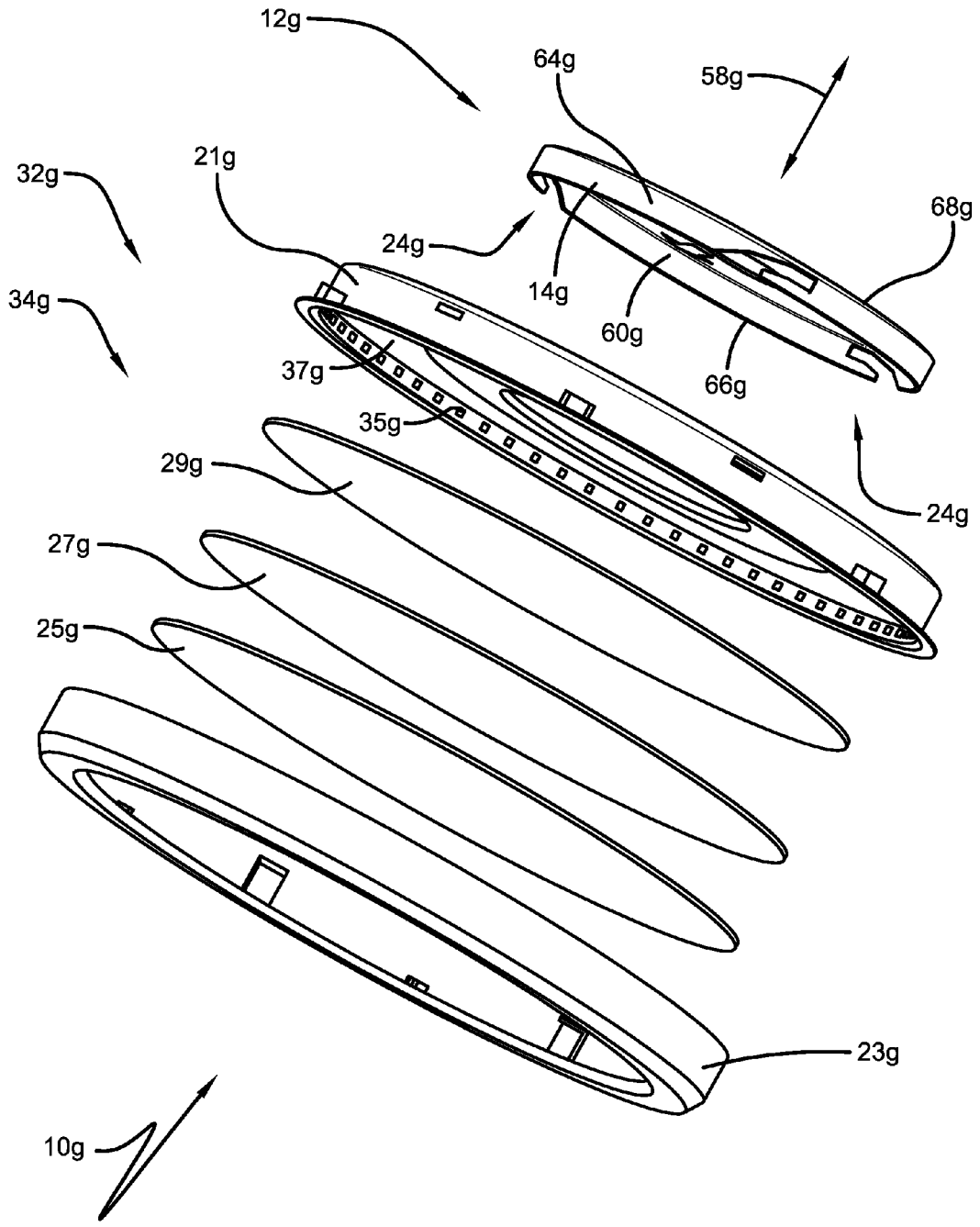
FIG. 14 is a second, more fully exploded view of the lighting assembly shown in FIG. 13.

FIGS. 13 and 14 are perspective views of another embodiment of the present disclosure. A lighting arrangement 10*g* can include a mounting ring 12*g* extending along a central longitudinal axis 58*g*. The mounting ring 12*g* can have a plurality of mounting apertures, such as aperture 22*g*. The mounting ring 12*g* can also have a circular wall 14*g* and a plurality of locking arms 24*g*.

The circular wall 14*g* can have an inwardly-facing surface 60*g* encircling the central longitudinal axis 58*g* and defining a cavity. The circular wall 14*g* can also have an outwardly-facing surface 64*g* opposite the inwardly-facing surface 60*g* with a thickness defined between the inwardly-facing surface 60*g* and the outwardly-facing surface 64*g*. The circular wall 14*g* can extend a height along the central longitudinal axis 58*g* between a downwardly-facing surface 66*g* and an upwardly-facing surface 68*g*.

Each of the plurality of locking arms 24*g* can be fixedly associated with the circular wall 14*g*. The plurality of exemplary locking arms 24*g* are defined in the circular wall 14*g*, rather than projecting radially from the circular wall 14*g*. Each of the plurality of locking arms 24*g* including an axial portion 26*g* extending along the central longitudinal axis 58*g* and a circumferential portion 28*g* extending about the central longitudinal axis 58*g*. Each of the circumferential portions 28*g* can extend from a first end at an intersection with one of the axial portions 26*g* to a respective second end distal relative to the first end. Each of the circumferential portion 28*gs* having an upper face and a lower face.

The lighting arrangement 10*c* can include a luminaire 32*g* having a housing assembly 34*g* and at least one light emitter and a plurality of posts 40*g*. The housing assembly 34*g* at least partially enclose the light emitter. The housing assembly 34*g* can be at least partially received in the cavity. Each of the plurality of posts 40*g* can extend away from the housing assembly 34*g*.

The exemplary light emitter can be defined by a plurality of light emitting diodes, such as diode 35*g*, that can be disposed about a perimeter wall 37*g* of a pan 21*g*. The plurality of light emitting diodes 35*g* can be directed toward a center of the luminaire 32*g* and generally at the central longitudinal axis 58*g*. The plurality of light emitting diodes 35*g* can be mounted on printed circuit boards.

The mounting ring 12*g* and the luminaire 32*g* can be interconnected by moving each of the plurality posts 40*g* past each of the plurality of distal ends of the locking arms 24*g* along the central longitudinal axis 58*g* and rotating the mounting ring 12*g* and the luminaire 32*g* relative to one another in a first angular direction about the central longitudinal axis 58*g*.

The luminaire 32*g* can include the pan 21*g* and also a lens 25*g*, a diffuser 27*g*, and a light guide 29*g* with a backing of reflective paper. The pan 21*g* can have the perimeter wall 37*g* extending about a central longitudinal axis 58*g*. The perimeter wall 37*g* can take any desired shape, including square, circular, oval, rectangular, or any other shape. The pan 21*g* can also have bottom lip projecting from the perimeter wall toward the central longitudinal axis 58*g*. The pan 21*g* can have a vertical height along the central longitudinal axis 58*g* between a bottom surface and a top surface. The pan 21*g* is proximate with the top surface of the pan 21*g* when the luminaire 32*g* is assembled.

A cavity can be defined vertically between the bottom lip of the casing 14*g* and the pan 21*g*. The lens 25*g*, diffuser 27*g*, and the light guide 29*g* with the backing of reflective paper 22*g* can be disposed in the cavity and rest on the bottom lip. The lens 25*g* can be at least partially transparent and can be formed from glass or 5VA plastic. The diffuser 27*g* and the light guide 29*g* can confront and contact one another.

Figure 15:
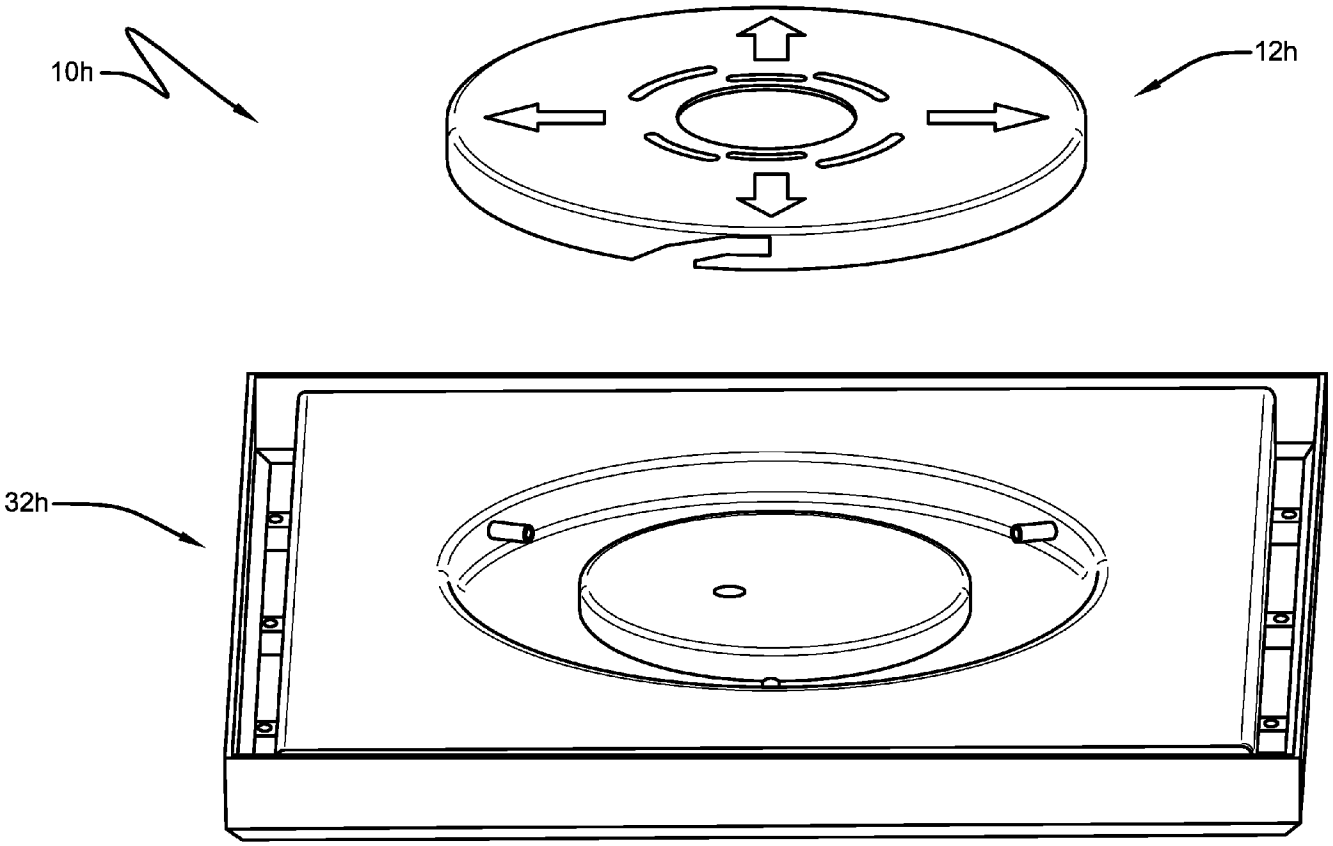
FIG. 15 is a partially-exploded view of a lighting assembly according to another exemplary embodiment of the present disclosure.

FIG. 15 is a perspective view of another embodiment of the present disclosure. A lighting arrangement 10*h* can include a mounting ring 12*h* and a luminaire 32*h*. The lighting arrangement 10*h* can be square, but otherwise similar to the lighting arrangement 10*g*.

Figure 17:
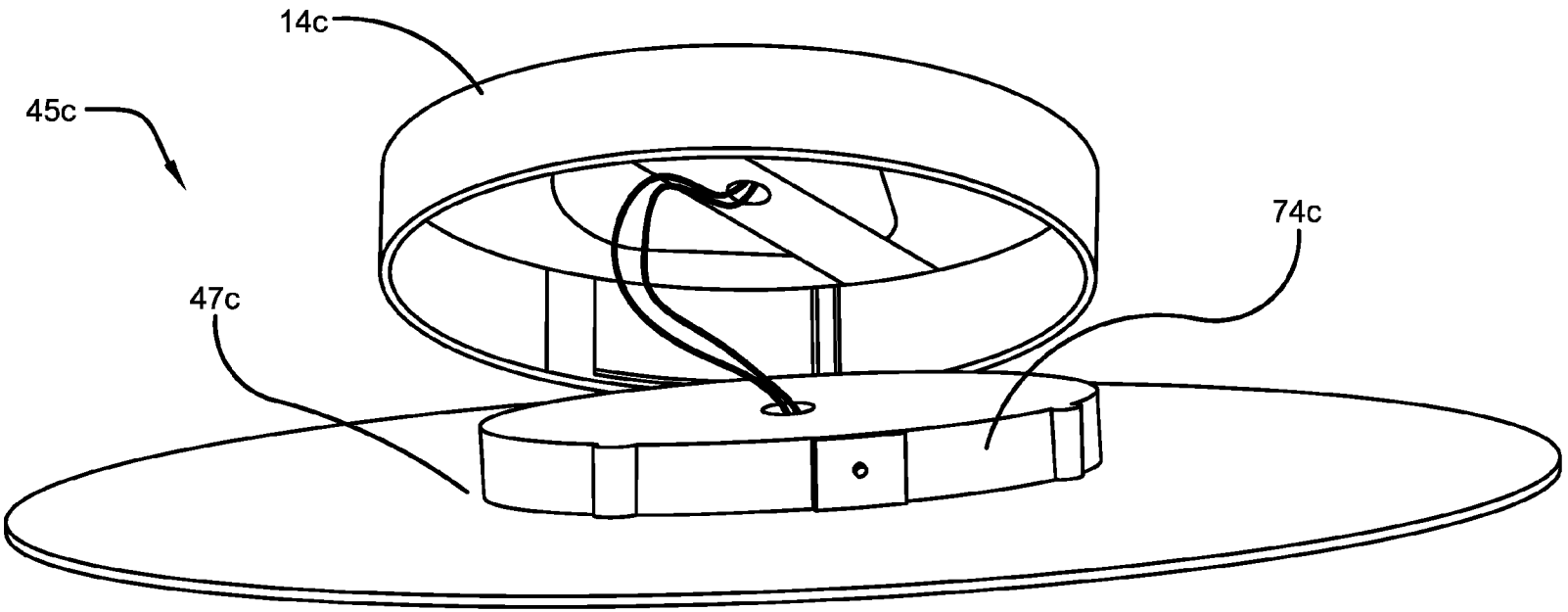
FIG. 17 is a perspective view of the structures shown in FIGS. 7-9 being coupled with a first shade.
Figure 18:
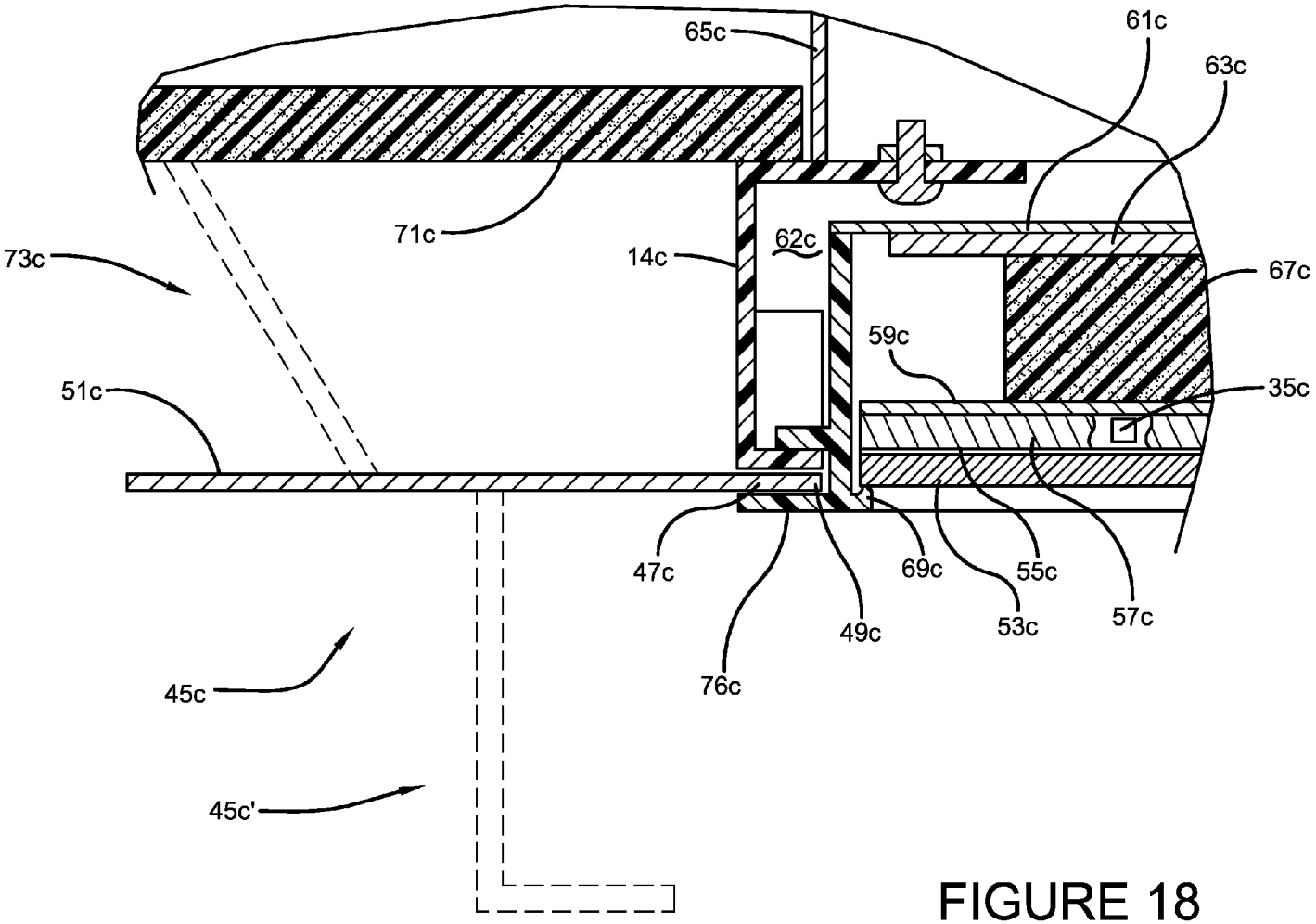
FIG. 18 is a partial cross-section of the structures shown in FIGS. 7-9 coupled with the first shade in a plane containing a central longitudinal axis.
Figure 19:
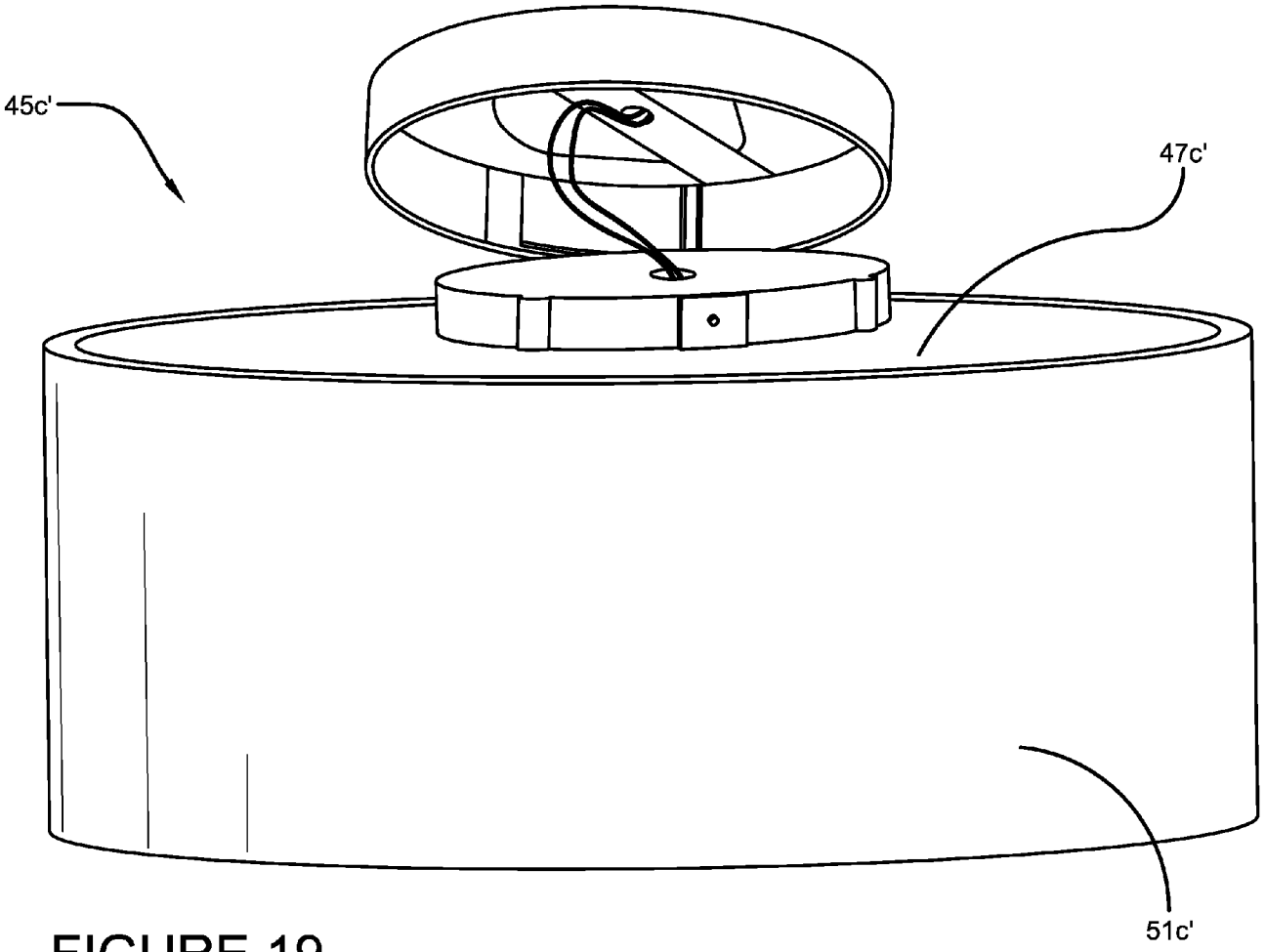
FIG. 19 is a perspective view of the structures shown in FIGS. 7-9 being coupled with a second shade.

Another feature of the present disclosure is illustrated in FIGS. 17-19. Referring now to FIGS. 17 and 18, the lighting arrangement 10*c* can also include a shade 45*c* having a collar portion 47*c* with an aperture 49*c* at least partially surrounding the body portion 74*c* and positioned between the upwardly-facing surface 82*c* of the flange portion 76*c* and the downwardly-facing surface 66*c* of the circular wall 14*c* when the mounting ring 12*c* and the luminaire 32*c* are interconnected. The shade 45*c* can also include a shading portion 51*c* extending radially outward from the collar portion 47*c* and radially beyond the flange portion 76*c* of the housing assembly 34*c* relative to the central longitudinal axis 58*c*.

Referring now to FIG. 18, the lighting arrangement 10*c* can be mounted to a junction box 65*c* proximate to a ceiling 71*c* can include a lens 53*c*, a diffuser 55*c*, a light guide 57*c* with a backing of reflective paper 59*c*, a plurality of light emitting diodes 35*c*, a backing plate 61*c*, and a driving circuit 63*c*. The lens 53*c*, diffuser 55*c*, and the light guide 57*c* with the backing of reflective paper 59*c* can be disposed within the body portion 74*c* and rest on a bottom lip 69*c* defined by the circular wall 14*c*. The lens 53*c* can be at least partially transparent and can be formed from glass or 5VA plastic. The diffuser 55*c* can be positioned between the driving circuit 63*c* and the bottom lip 69*c* along the axis 58*c*. The light guide 57*c* can be positioned between the driving circuit 63*c* and the diffuser 55*c* along the axis 58*c*. The diffuser 55*c* and the light guide 57*c* can confront and contact one another. A gap can be defined between the driving circuit 63*c* and the diffuser 55*c* along the axis 58*c*. A block 67*c* of EVA foam can be positioned between the driving circuit 63*c* and the light guide 57*c*/backing of reflective paper 59*c* along the axis 58*c*.

The light guide 55*c* has been partially cut-away in FIG. 18 to show one of the light emitting diodes 35*c*. The plurality of light emitting diodes 35*c* can be disposed about the inwardly-facing surface of the body portion 74*c*. The plurality of light emitting diodes 35*c* can be directed at a side of the light guide 57*c* and generally at the axis 58*c*. The plurality of light emitting diodes 35*c* can be mounted on one or more printed circuit boards.

The shade 45*c* can be translucent or opaque and can shield an area from receiving light. The exemplary shade 45*c* shields a portion of the ceiling 71*c*. The exemplary collar portion 47*c* and exemplary shading portion 51*c* are flat and coplanar with respect to one another. Thus, the exemplary shade 45*c* does not extend beyond the flange portion along the central longitudinal axis 58*c* and does not extend beyond the upwardly-facing surface 68*c* of the circular wall 14*c* along the central longitudinal axis 58*c*. It is noted that perimeter of the shade 45*c*, when viewed in a plane perpendicular to the axis 58*c*, can take any shape including circular, oval, star, flower, sun, or irregular. It is noted that the shade 45*c* can be any color and can bare images or patterns of color.

FIG. 18 shows, in phantom, other shapes a shade can take in other embodiments of the present disclosure. A shade can extend to the ceiling as referenced at 73*c*. FIG. 19 shows an alternative shade 45*c*' having a drum shape. A shading portion 51*c*' of the shade 45*c*' extends downward, beyond the collar portion 47*c*' and the flange portion 76*c* along the central longitudinal axis 58*c*. The profile of the shade 45*c*' is shown in phantom in FIG. 18. It is noted that the shade 45*c*' can be partially translucent and partially opaque and can bare color patterns or images.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or subcombinations that are disclosed herein as other present disclosures in other patent documents is hereby unconditionally reserved.

What is claimed is:

1. A lighting arrangement comprising:

a mounting ring extending along a central longitudinal axis and having a plurality of mounting apertures and a circular wall, said circular wall having an inwardly-facing surface encircling said central longitudinal axis and defining a radial boundary of a cavity, said circular wall also having an outwardly-facing surface opposite to said inwardly-facing surface with a thickness of said circular wall defined between said inwardly-facing surface and said outwardly-facing surface, said circular wall extending a height along said central longitudinal axis between a downwardly-facing surface and an upwardly-facing surface;

a luminaire having a housing assembly and a light emitter, said housing assembly at least partially enclosing said light emitter, said housing assembly at least partially received in said cavity;

a plurality of locking arms each fixedly associated with one of said circular wall and said housing assembly, each of said plurality of locking arms including an axial portion extending along said central longitudinal axis and a circumferential portion extending about said central longitudinal axis, each of said circumferential portions extending from a first end at an intersection with one of said axial portions to a respective second end distal relative to said first end, and each of said circumferential portions having an upper face directed in the same direction as said upwardly-facing surface and a lower face directed in the same direction as said downwardly-facing surface;

a plurality of posts each fixedly associated with the other of said circular wall and said housing assembly, each of said plurality of posts extending away from said other of said circular wall and said housing assembly along a respective post axis that intersects said central longitudinal axis, a width of each post defined in a direction about said central longitudinal axis;

wherein said mounting ring and said luminaire are interconnected by moving each of said plurality posts past each of said plurality of second ends along said central longitudinal axis and then rotating said mounting ring and said luminaire relative to one another in a first angular direction about said central longitudinal axis and sliding each of said plurality of posts along one of said upper and lower faces such that said one of said upper and lower faces thereby defines a sliding surface;

wherein said sliding surface includes a first area that is substantially flat in side profile and extends a first arcuate length about said central longitudinal axis, a second area that is substantially flat in side profile and extends a second arcuate length about said central longitudinal axis, and at least one protuberance creating a gap between said first area and said second area and extending a third arcuate length about said central longitudinal axis;

wherein, for at least one of said plurality of posts and said respective sliding surface, said at least one of said plurality of posts is configured to slide over said first area and said at least one protuberance and said second area of said respective sliding surface; and wherein said third arcuate length is less than both of said first arcuate length and said second arcuate length.

2. The lighting arrangement of claim 1 wherein said sliding surface further comprises:

a third area that is substantially flat in side profile and extends a fourth arcuate length about said central longitudinal axis; and said at least one protuberance further comprises a first protuberance between said first area and said second area and second protuberance between said second area and said third area and extending a fifth arcuate length about said central longitudinal axis.

3. The lighting arrangement of claim 1 wherein a width of said at least one of said plurality of posts is greater than said third arcuate length.

4. The lighting arrangement of claim 1 wherein said at least one protuberance is further defined as a positive protuberance being extending above and elevated over said first area and said second area with respect to said central longitudinal axis.

5. The lighting arrangement of claim 1 wherein said at least one protuberance is further defined as a negative protuberance being extending below and vertically recessed with respect to said first area and said second area relative to said central longitudinal axis.

6. The lighting arrangement of claim 1 wherein said sliding surface is defined by one of said upper faces.

7. The lighting arrangement of claim 1 wherein said plurality of locking arms are fixed with respect to said mounting ring.

8. The lighting arrangement of claim 2 wherein said fifth arcuate length is less than both of said second arcuate length and said fourth arcuate length.

9. The lighting arrangement of claim 7 wherein said plurality of locking arms project from one of said inwardly-facing surface and said outwardly-facing surface of said circular wall.

10. The lighting arrangement of claim 7 wherein said plurality of locking arms are defined by said circular wall.

11. A lighting arrangement comprising:

a mounting ring extending along a central longitudinal axis and having a plurality of mounting apertures and a circular wall, said circular wall having an inwardly-facing surface encircling said central longitudinal axis and defining a radial boundary of a cavity, said circular wall also having an outwardly-facing surface opposite to said inwardly-facing surface with a thickness of said circular wall defined between said inwardly-facing surface and said outwardly-facing surface, said circular wall extending a height along said central longitudinal axis between a downwardly-facing surface and an upwardly-facing surface;

a luminaire having a housing assembly and a light emitter, said housing assembly at least partially enclosing said light emitter, said housing assembly at least partially received in said cavity;

a plurality of locking arms each fixedly associated with one of said circular wall and said housing assembly, each of said plurality of locking arms including an axial portion extending along said central longitudinal axis and a circumferential portion extending about said central longitudinal axis, each of said circumferential portions extending from a first end at an intersection with one of said axial portions to a respective second end distal relative to said first end, and each of said circumferential portions having an upper face directed in the same direction as said upwardly-facing surface and a lower face directed in the same direction as said downwardly-facing surface;

a plurality of posts each fixedly associated with the other of said circular wall and said housing assembly, each of said plurality of posts extending away from said other of said circular wall and said housing assembly along a respective post axis that intersects said central longitudinal axis, a width of each post defined in a direction about said central longitudinal axis;

wherein said mounting ring and said luminaire are interconnected by moving each of said plurality posts past each of said plurality of second ends along said central longitudinal axis and then rotating said mounting ring and said luminaire relative to one another in a first angular direction about said central longitudinal axis and sliding each of said plurality of posts along one of said upper and lower faces such that said one of said upper and lower faces thereby defines a sliding surface;

wherein said sliding surface further comprises:

a first ramp portion having a first rate of incline and extending about said central longitudinal axis a first angular distance; and a second ramp portion having a second rate of incline and extending about said central longitudinal axis a second angular distance, said second rate of incline different than said first rate of incline.

12. The lighting arrangement of claim 11 wherein said post engages said first ramp portion before said second ramp portion and wherein said first rate of incline is greater than said second rate of incline.

13. The lighting arrangement of claim 11 wherein said first rate of incline is greater than said second rate of incline and wherein said first angular distance is less than said second angular distance.

14. A lighting arrangement comprising:

a mounting ring extending along a central longitudinal axis and having a plurality of mounting apertures and a circular wall, said circular wall having an inwardly-facing surface encircling said central longitudinal axis and defining a radial boundary of a cavity, said circular wall also having an outwardly-facing surface opposite to said inwardly-facing surface with a thickness of said circular wall defined between said inwardly-facing surface and said outwardly-facing surface, said circular wall extending a height along said central longitudinal axis between a downwardly-facing surface and an upwardly-facing surface;

a luminaire having a housing assembly and a light emitter, said housing assembly at least partially enclosing said light emitter, said housing assembly at least partially received in said cavity;

a plurality of locking arms each fixedly associated with one of said circular wall and said housing assembly, each of said plurality of locking arms including an axial portion extending along said central longitudinal axis and a circumferential portion extending about said central longitudinal axis, each of said circumferential portions extending from a first end at an intersection with one of said axial portions to a respective second end distal relative to said first end, and each of said circumferential portions having an upper face directed in the same direction as said upwardly-facing surface and a lower face directed in the same direction as said downwardly-facing surface;

a plurality of posts each fixedly associated with the other of said circular wall and said housing assembly, each of said plurality of posts extending away from said other of said circular wall and said housing assembly along a respective post axis that intersects said central longitudinal axis, a width of each post defined in a direction about said central longitudinal axis;

wherein said mounting ring and said luminaire are interconnected by moving each of said plurality posts past each of said plurality of second ends along said central longitudinal axis and then rotating said mounting ring and said luminaire relative to one another in a first angular direction about said central longitudinal axis and sliding each of said plurality of posts along one of said upper and lower faces such that said one of said upper and lower faces thereby defines a sliding surface;

wherein:

said housing assembly further comprises a body portion extending between top and bottom ends along said central longitudinal axis and a flange portion extending radially-outward from said bottom end of said body portion and having an upwardly-facing surface and a downwardly-facing surface, wherein said body portion is at least partially received in said cavity and said upwardly-facing surface of said flange portion and said downwardly-facing surface of said circular wall are directed toward one another when said mounting ring and said luminaire are interconnected; and said lighting arrangement further comprises a shade having a collar portion with an aperture at least partially surrounding said body portion and positioned between said upwardly-facing surface of said flange portion and said downwardly-facing surface of said circular wall when said mounting ring and said luminaire are interconnected, said shade further comprising a shading portion extending radially outward from said collar portion and radially beyond said flange portion of said housing assembly relative to said central longitudinal axis, and wherein said mounting ring positions said luminaire adjacent to a ceiling or wall mounting location and wherein a radially-outermost edge of said shading portion is configured to be positioned outside of the ceiling or wall mounting location.

15. The lighting arrangement of claim 14 wherein said collar portion and said shading portion are further defined as flat and coplanar with respect to one another.

16. The lighting arrangement of claim 14 wherein said downwardly-facing surface of said circular wall is further defined as configured to be positioned outside of the ceiling or wall mounting location and wherein said shade extends beyond said downwardly-facing surface of said circular wall along said central longitudinal axis in a direction along said central longitudinal axis away from said flange portion.

17. The lighting arrangement of claim 14 wherein said shading portion of said shade is further defined as extending beyond said flange portion along said central longitudinal axis in a direction along said central longitudinal axis away from said mounting ring.

18. The lighting arrangement of claim 14 wherein said shading portion of said shade is further defined as extending beyond said collar portion along said central longitudinal axis in a direction along said central longitudinal axis away from said mounting ring or away from said flange portion.

19. The lighting arrangement of claim 14 wherein most of said body portion is disposed in said cavity.

* * * * *